US006257106B1

(12) United States Patent
Anderson et al.

(10) Patent No.: US 6,257,106 B1
(45) Date of Patent: Jul. 10, 2001

(54) HAND/SURVIVAL TOOL HAVING MULTIPLE IMPLEMENTS

(76) Inventors: Wayne Anderson, 65 Grove St.; Paolo Cassutti, 8 N. Creek Rd., both of Northport, NY (US) 11729

( * ) Notice: Subject to any disclaimer, the term of this patent is extended or adjusted under 35 U.S.C. 154(b) by 0 days.

(21) Appl. No.: 09/237,557

(22) Filed: Jan. 26, 1999

Related U.S. Application Data

(63) Continuation-in-part of application No. 08/904,666, filed on Aug. 1, 1997, which is a continuation-in-part of application No. 08/620,471, filed on Mar. 22, 1996, now abandoned, which is a continuation-in-part of application No. 08/451,398, filed on May 26, 1995, now Pat. No. 5,711,194.

(51) Int. Cl.[7] ..... B25B 7/22

(52) U.S. Cl. ..... 81/440; 81/177.4; 81/177.6; 7/129; 7/168; 7/165

(58) Field of Search ..... 81/437–440, 177.4, 81/177.6, 177.85, 124.5, 490; 7/118, 165, 127–129, 131, 167–168, 125, 139, 142, 158

(56) References Cited

U.S. PATENT DOCUMENTS

| | | | | |
|---|---|---|---|---|
| 3,114,401 | * | 12/1963 | Johnson . | |
| 4,448,097 | * | 5/1984 | Rocca . | |
| 5,781,950 | * | 7/1998 | Swinden et al. | 7/128 |
| 5,809,600 | * | 9/1998 | Cachot . | |
| 5,979,059 | * | 11/1999 | Leatherman et al. | 7/128 |

* cited by examiner

*Primary Examiner*—D. S. Meislin
(74) *Attorney, Agent, or Firm*—Lackenbach Siegel Marzullo Aronson & Greenspan

(57) ABSTRACT

A hand tool has a pliers with pivotably disposed handles with one handle having a closed ended sleeve pivotably connected to one handle head for removably operably receiving tool with the sleeve non-removably bits pivoting 180° from an inoperable position between the handle sides to an operable position, and the other handle has a plurality of bladed tools pivotally connected to the other handle end.

16 Claims, 23 Drawing Sheets

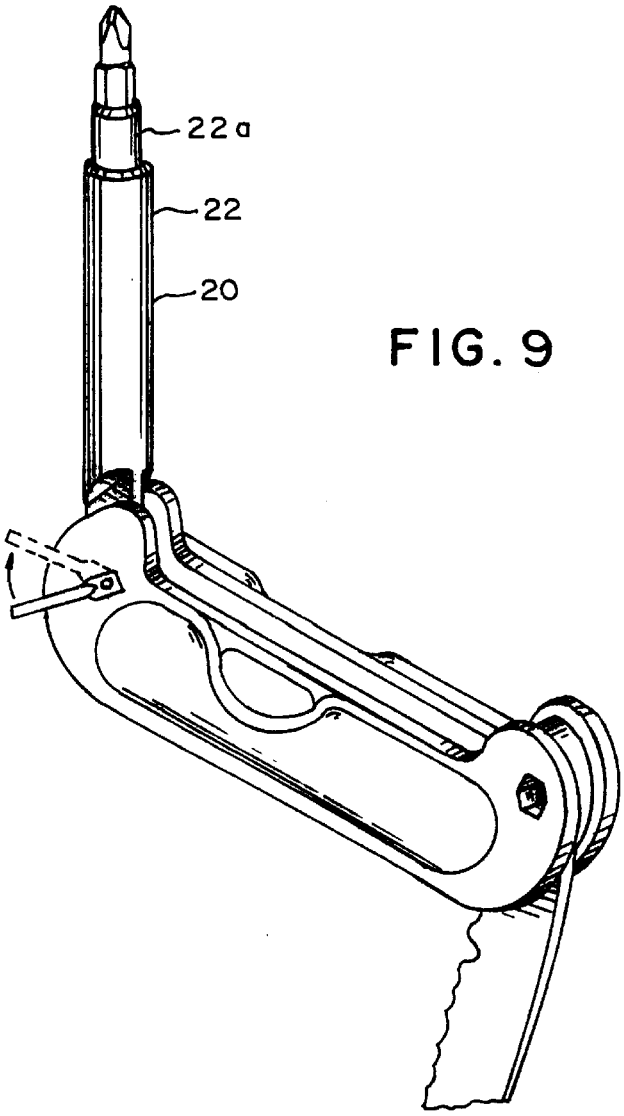
FIG. 9
FIG. 10
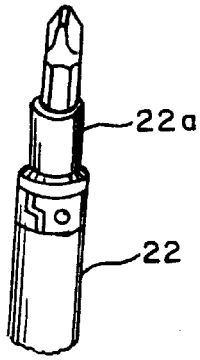
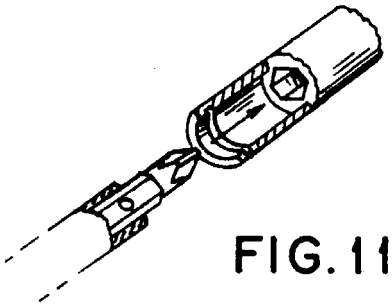
FIG. 11
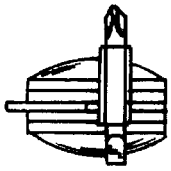
FIG. 8

HAND/SURVIVAL TOOL HAVING MULTIPLE IMPLEMENTS

PRIOR RELATED APPLICATIONS

This application is a continuation-in-part application of Ser. No. 08/904,666, filed Aug. 1, 1997, which is a continuation-in-part of U.S. Ser. No. 08/620,471, filed Mar. 22, 1996, now abandoned and which is a continuation-in-part of U.S. Ser. No. 08/451,398, filed May 26, 1995, now U.S. Pat. No. 5,711,194, granted Jan. 27, 1998, Also, this application relates to our copending U.S. patent application entitled IMPROVED HEX KEY HAND TOOL AND FOLDING SCREW/NUT DRIVER, Ser. No. 08/904,665 filed on Aug. 1, 1997.

BACKGROUND OF THE INVENTION

The present invention pertains to multi-purpose hand tools, and more particularly to a Leatherman's type hand tool or Swiss army knife, but with improved features, such as an inter-changeable 4 in 1 or screw nut driver even an 8 in 1 driver tool, as well as other novel improved wrench and plier hand tools.

Incorporation of multiple tool functions or abilities into a single tool device is a well-known convenience, as is incorporation of multiple blades and tools which may be designed to 'fold' into a handle, such as in a conventional pocket knife configuration. Such blades and tools do not themselves generally fold, but are hinged to the handle, and the combination blade and handle are said to fold closed for safe and convenient transport and unfold, or hinge open, for use. In such conventional pocket knife configurations as are known to the applicant, each blade and tool function is represented by a single operative member, such as a knife blade or a screwdriver blade, which are combined in some stacked arrangement to hinge with respect to the handle. On the other hand, multipurpose tools are known which do not fold, such as interchangeable bit screwdrivers, wrenches, pliers, etc.

SUMMARY OF THE INVENTION

The present invention provides a self-contained, improved hand tool having no loose parts, such as folding pocket-type knives with the flexibility and functionality of multipurpose tools. The present invention provides,. among other hand tools, a folding combination pocket-type knife with the professional usefulness of interchangeable bit screwdrivers and offset screwdrivers using the same interchangeable bit. In particular, the present invention provides hinged sleeve means which removably retains screwdriver bits in hinged relationship to a handle adapted to receive the sleeve and bit in recessed storage relationship and in exposed functioning relationship. The sleeve means has retaining means which cooperates with the bit to removably secure the bit in the sleeve. The double ended bit is interchangeable with other bits and is reversible, having a different drive at each end.

Also provided is an hexagonal cross-hole, extending from one side bolster to the other of the handle, to receive the interchangeable bits in perpendicular relation to the handle, creating an offset interchangeable bit section of the invention. Retractable and/or biasable ball retaining means, or magnets, or retaining clips on each interchangeable bit may be used to retain the offset bit by fitting between the side bolsters and being retained thereby. Also, with the various hand tools of the invention, the folding blades may suitably have conventional provisions for locking in the open positions any of the tools for safety so as to prevent tools and blades from unexpectedly snapping closed.

BRIEF DESCRIPTION OF THE DRAWINGS

FIG. 8 is an end view of the folding knife and interchangeable bit screwdriver of the invention shown in FIG. 7.

FIG. 9 is a perspective view of the folding knife and interchangeable bit screwdriver of the invention shown in FIG. 6.

FIG. 10 is a fragmentary perspective view of the sleeve-in-sleeve and bit of the folding knife and interchangeable bit screwdriver of the invention.

FIG. 11 is a fragmentary perspective view, partly broken away, of a bit being inserted into the sleeve-in-sleeve of the folding knife and interchangeable bit screwdriver of the invention.

DESCRIPTION OF THE PREFERRED EMBODIMENTS

Figure 1:
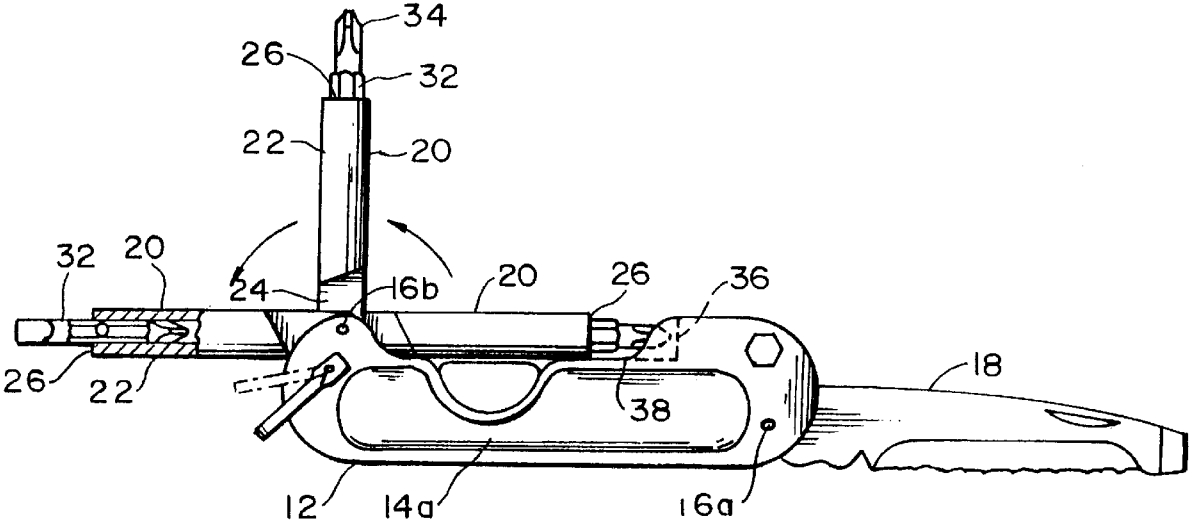
FIG. 1 is plan view of the folding knife and interchangeable bit screwdriver of the invention showing the sleeve and bit in closed and operative positions and a knife blade in operative position.
Figure 2:
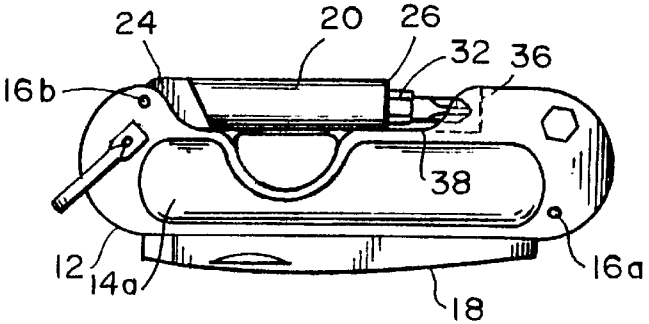
FIG. 2 is a plan view of the folding knife and interchangeable bit screwdriver of the invention as shown in FIG. 1 in closed position.
Figure 4:
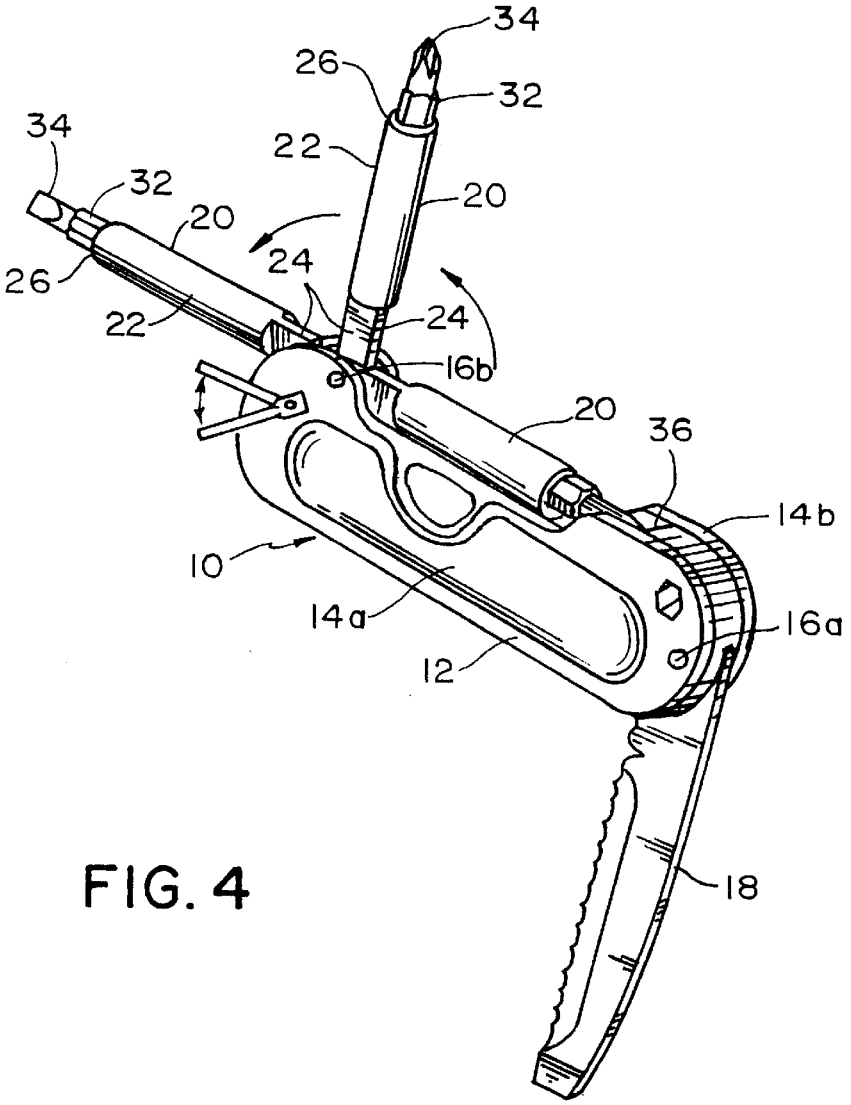
FIG. 4 is a perspective view of the folding knife and interchangeable bit screwdriver of the invention showing the sleeve and bit in closed and operative positions and a knife blade in partially open position.
Figure 3:
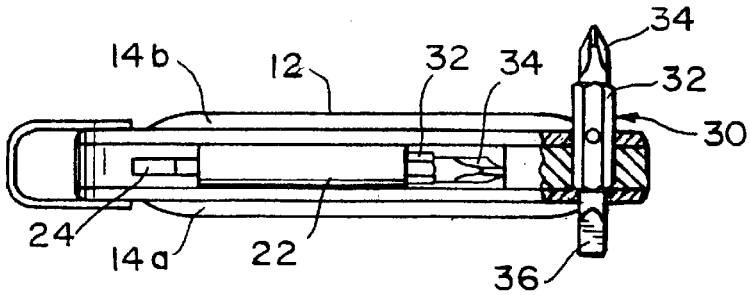
FIG. 3 is a top view of the folding knife and interchangeable bit screwdriver of the invention showing a screwdriver bit in offset position.

With reference to FIGS. 1–13 of the drawings, the folding knife and interchangeable bit screwdriver of the invention 10 comprises handle means 12 having a pair of spaced similarly shaped side bolsters 14*a* and 14*b*. A plurality of hinge pins 16*a* and 16*b* are provided, each traversing between side bolsters 14*a* and 14*b* and perpendicular to the longitudinal axis of handle means 12. In the preferred embodiment, at least one hinge pin is provided at each end of handle means 12. Rotatably attached to one hinge pin 16*a* is a knife blade 18 which swivels about hinge pin 16*a* from a closed position partly or entirely recessed in handle means 12, as shown in FIG. 2, to a partly open position as shown in FIG. 4, to a fully open and operative position as shown in FIG. 1.

Rotatably attached to hinge pin 16*b* is sleeve means 20, comprising hollow tube means 22 having a hinged end 24 and an open end 26 opposite hinged end 24. The interior of hollow tube means 22 is hexagonal in cross section.

Reversible screwdriver bit 30 comprises a central shoulder section 32 which is noncircular in cross section, preferably hexagonal, and is adapted to slidably fit within hollow tube means 22. Each end of reversible bit 30 has a screwdriver drive. As shown in the drawing, reversible bit 30 has a Phillips drive end 34 and a crosscut drive end 36, but any combination of useful screwdriver configurations may be used. The screwdriver ends are smaller in cross section than the cross section of shoulder section 32 to permit insertion into hollow tube means 22. Reversible bit 30 may be inserted into hollow tube means 22 with either end exposed for use and may be withdrawn and reversed for use of the opposite end. Sleeve means 20 is rotatable about hinge pin 16*b* from an open position, at any angle with respect to the longitudinal axis of handle means 12, or closed wholly or partially within a recess 36 provided in handle means 12 for the purpose.

Figure 6:
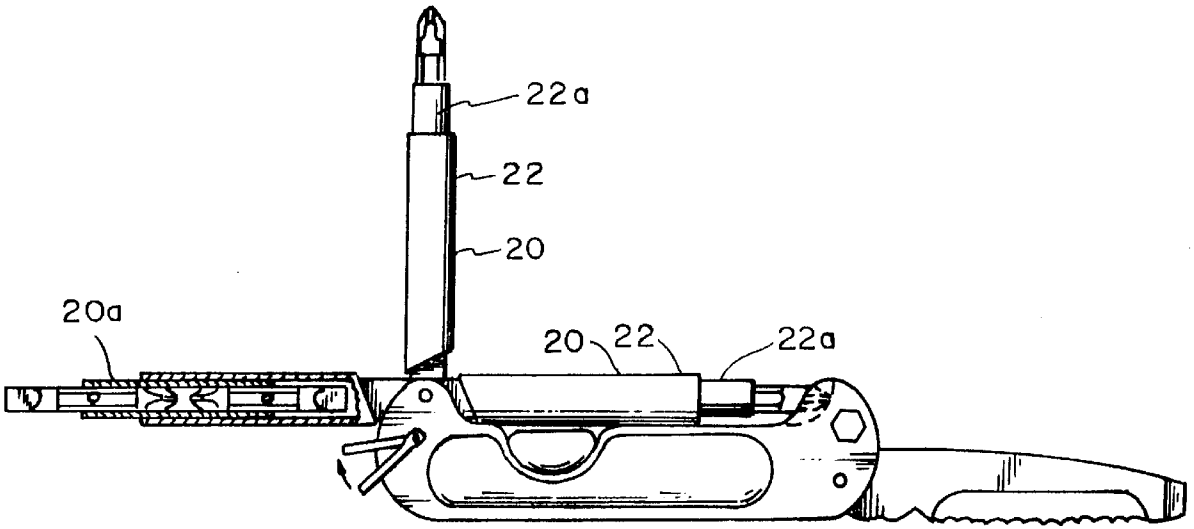
FIG. 6 is a plan view of the folding knife and interchangeable bit screwdriver of the invention showing a sleeve-in-sleeve version of the invention in closed and operative positions and partially broken away to show the internal construction, and a knife blade in operative position.
Figure 5:
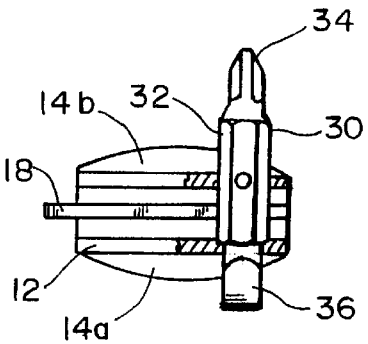
FIG. 5 is an end view of the folding knife and interchangeable bit screwdriver of the invention as shown in FIG. 3.
Figure 7:
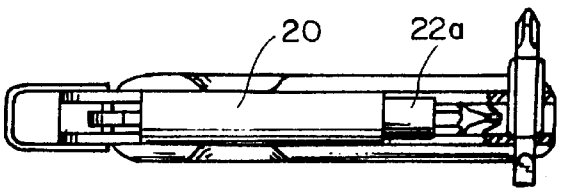
FIG. 7 is a top view of the folding knife and interchangeable bit screwdriver of the invention of FIG. 6, showing the sleeve-in-sleeve and a bit in closed position and a bit in offset position.
Figure 12:
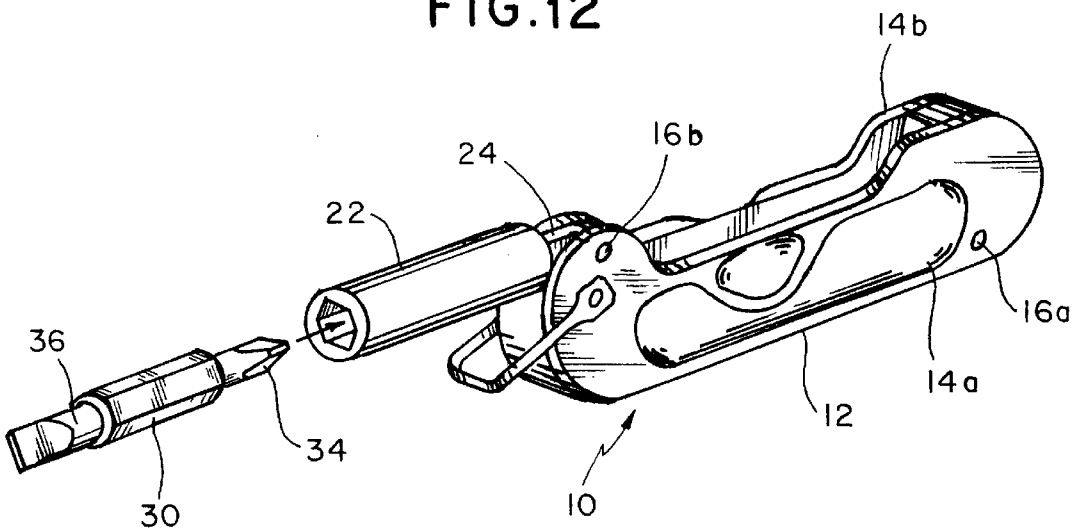
FIG. 12 is a perspective view of a magnetic retainer version of the folding knife and interchangeable bit screwdriver of the invention.
Figure 13:
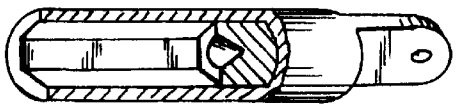
FIG. 13 is a perspective fragmentary view, partly broken away, of the magnetic retainer version of the folding knife and interchangeable bit screwdriver of the invention.
Figure 14:
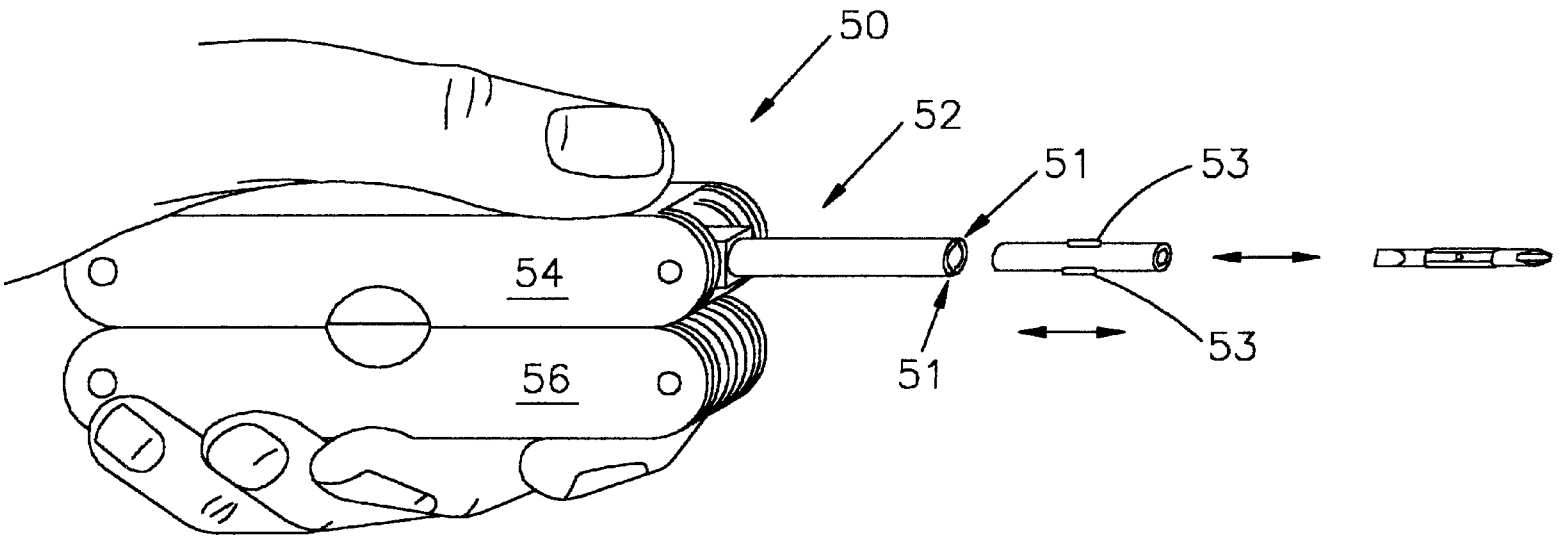
FIG. 14 is a perspective, partially exploded view of the improved hand/survival tool with multiple functions/purposes, and with a 4 in 1 interchangeable screwdriver shown in one of the hinged or folding blade-like implements forming part of the hand tool.

Retaining means are provided on each reversible bit 30 to removably retain each bit in hollow tube means 30. In the preferred embodiment, such retaining means comprise a spring-loaded ball 35. Means such as spring-loaded detents may be provided to retain hollow tube means 30 in closed, 90° open and 180° open positions as shown in FIGS. 1, 4 and 6. Reversible bits 30 may also be referred to as interchangeable bit means.

Side bolsters 14*a* and 14*b* are provided with a central depression 38 adapted to receive the user's fingers when using knife 18 to help prevent the fingers from sliding onto the knife blade. With appropriate location of hinge pin 16*b* adjacent depression 38, sleeve means 20 may close into depression 38 as well as into recess 36 when closed. Hingedly opening sleeve means 20 exposes depression 38 for use.

With one reversible bit 30, a 2-in-1 folding screwdriver means is provided. The invention also provides a 4-in-1 folding screwdriver means as shown in FIGS. 6–11. Sleeve means 20 is provided with an inner sleeve 22*a* which is slidably secured within hollow tube 22. Means are provided to prevent inner sleeve 22*a* from rotating relative to hollow tube 22, such as by having the exterior of inner sleeve 22*a* hexagonal in cross section to mate with the hexagonal interior of hollow tube 22. Inner sleeve 22*a* itself has a hexagonal interior adapted to receive and matingly engage shoulder section 32 of reversible bit 30 such that there is no relative rotational motion therebetween. Inner sleeve 22*a* is sufficiently long to receive two reversible bits 30 at the same time, yielding four bit ends for use by reversing either bit in inner sleeve 22*a*, or by reversing inner sleeve 22*a* in hollow tube 22.

Referring now, and more particularly, to FIGS. 14–45, there is shown a number of alternate and improved modifications and alternate constructions of the hand tool of the invention with various implements generally pivotably mounted to at least the distal end of one of the tool handles. More particularly, as shown therein, the hand tool of FIGS. 14–19 is very much like the conventional Leatherman's plier tool, made and sold by the United States company known as the Leatherman Tool Group, Inc. However, here the improved hand/survival tool 50 embodies a tool having no loose parts, in addition to other conventional tools, knives, etc., either in a 4 in 1 or an 8 in 1 screw-nut driver tool (4 in 1 shown) by the reference numeral 52, the only difference being that with the 8 in 1 tool, a longer handle would be required due to the need for a longer "master" inner sleeve 52, and a generally wider or bulkier handle due to the need for an outer holding sleeve and the reversible master inner sleeve and reversible "servant" sleeves having reversible driver tools and/or bit drivers, depending upon the length and diameter of the drive bits. It will be appreciated that the longer master or outer sleeve in an 8 in 1 tool securely holds and precludes rotation between itself and the shorter servant or inner sleeves of the pair of oppositely disposed 4 in 1 tool elements at the distal ends of the long inner sleeve. Nevertheless, it is also within the practice of the invention for the master and/or servant sleeves, as well as the screwdriver bits themselves to be either symmetrical or asymmetrical (long or short reach), similar to that disclosed in our copending U.S. patent application Ser. No. 08/620,471 incorporated herein by reference.

In FIGS. 14–19, the improved multipurpose hand tool 50 includes a pair of handles 54 and 56, which in the case of a Leatherman-like hand tool, both handles are pivotable to their respective jaws 58 and 60 at their front or proximal ends 62 and 64, with the movable jaws themselves being centrally pivotable about the tool's primary axis or pivot pin 66. While the jaws shown therein are illustrated as blunt at their ends ("cut-off" type), other various types of jaws are also applicable to the present invention, including the long nose type, where the jaws are generally more slender and elongated in shape, such as long nose pliers made and sold by the American Tool Companies of Kenosha, Wis., and DeWitt, Nebr., but without the over-toggle clamping means normally associated with a locking hand tool pliers.

Each of the folding handles 54 and 56 have a respective storage cavity 54' and 56' for storing a respective jaw 58 and 60, as well as the one or more tool implements pivotally mounted at the opposite distal jaw ends 66 and 68. One of the handles 54 may be suitably provided with either a 4 in 1 or 8 in 1 driver tool. In the illustrated embodiment of the improved hand tool of the invention, a 4 in 1 screwdriver 70 is shown, with its reversible sleeve or integral tube means 72 having a pair of reversible bits 73 and 75, removably seated at opposite ends in cavities or compartments, each reversible driver bit embodying a Phillips type screwdriver 74, 74' and a more conventional flat blade type screwdriver 76, 76' at opposite ends of the reversible bit driver. Both the reversible bits and the reversible sleeve or tube means 72 are suitably retained or held in place in their carriers by conventional means, such as biasable ball detents, suitable magnets, retaining clips, such as C or U-shaped and the like. In addition, as noted in the embodiments of FIGS. 1–13, means are provided to prevent the reversible sleeve 72 from rotating relative to the pivotable, outer hollow tube 52, such as by conventional grooves in the outer sleeve and mating ears on the inner sleeve, or as shown in said figures by having the exterior of the sleeve 72 hexagonal in cross section so as to mate with the hexagonal interior of the hollow tube 52.

Furthermore, the reversible sleeve 72 itself is also provided with a hexagonal interior for matingly receiving and engaging a shoulder section 32' of the reversible bits so that rotational motion may be transmitted from the handles to the hollow tube 52 to the reversible sleeve 72 and to the reversible bit, and thence to the fastener (not shown) being driven or removed from a wall or surface in which the fastener is located.

At the proximal tool end are located the pivotable and mating jaws 58 and 60, both of which are movable in synchronism with each other. Each is provided with a mating jaw face having a suitable knurl or other gripping means (not shown) and teeth 78 and 80 for gripping a nut, rod, pipe or other object, and a cutter with anvil 82 and 84.

The other handle 56 is suitably equipped with any number of other pivotable tools, such as knives, bottle openers, screwdrivers, ruler-file, serrated saw, blade, scissors, awl-punch, fish scaler, can opener, Phillips or slotted screwdriver and the like. As shown therein, the four tools are a bottle opener/flat screwdriver, another flat blade screwdriver, file and awl-punch.

Figure 20:
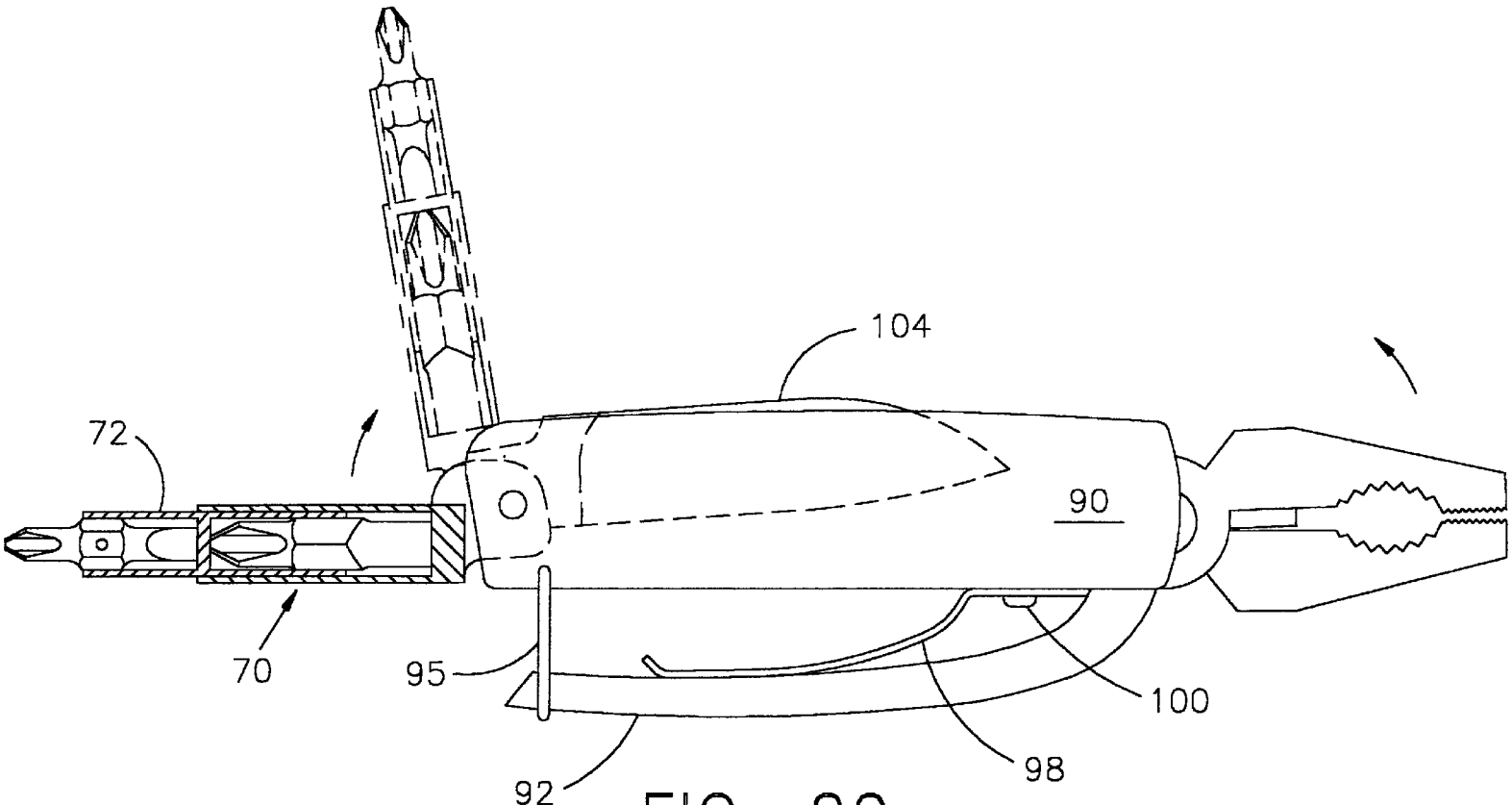
FIGS. 20–22 are various views, partly in section, of an alternative form of the improved hand/survival tool, but with only one large handle, having a cavity for storing all of the tools (knife, 4 in 1 driver bit tool, etc.), except the pliers, with the other small handle operating the sole movable or pivotable jaw of the pliers.
Figure 21:
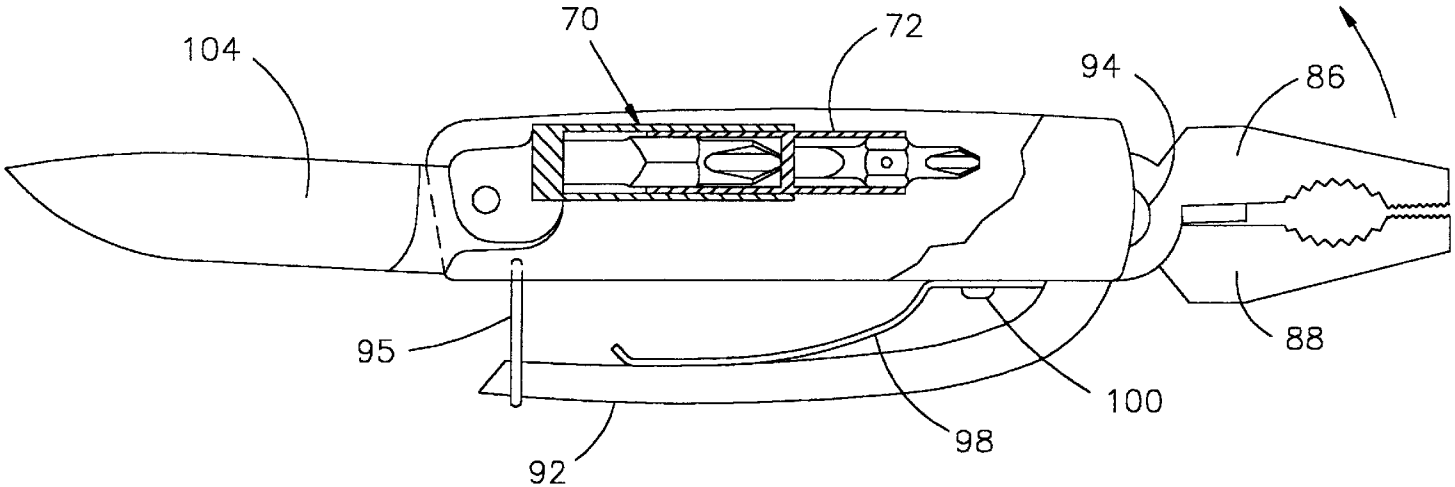
Figure 22:
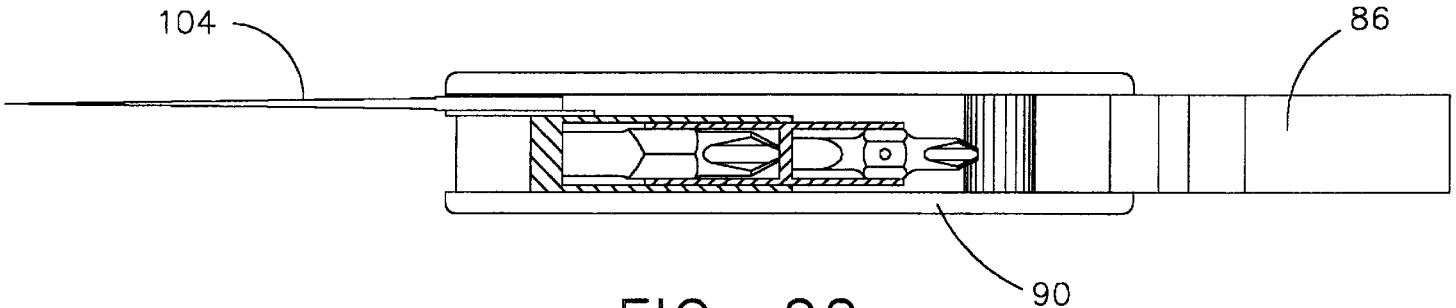

As best shown with like numerals, the tool of FIGS. 20–21, 21(A&B) and 22, illustrate another plier-like tool with a pivotable sleeve for a 4 in 1 driver tool, but with only one movable jaw 86 as shown by the reference arrow, the other jaw 88 being fixed to larger fixed handle 90. The movable handle 92 is pivotable about the fixed handle by means of axis point or pivot pin 94 and such handle is suitably held in the closed position by a pivotable U-shaped element 96 which may also serve as a loop for holding the improved hand tool to one's belt loop or chain attached to a pair of pants. Optionally, a spring element 98 may be secured to the handle 90 by means of fastener 100 to biasably urge the movable jaw 86 to an open position.

Figure 21A:
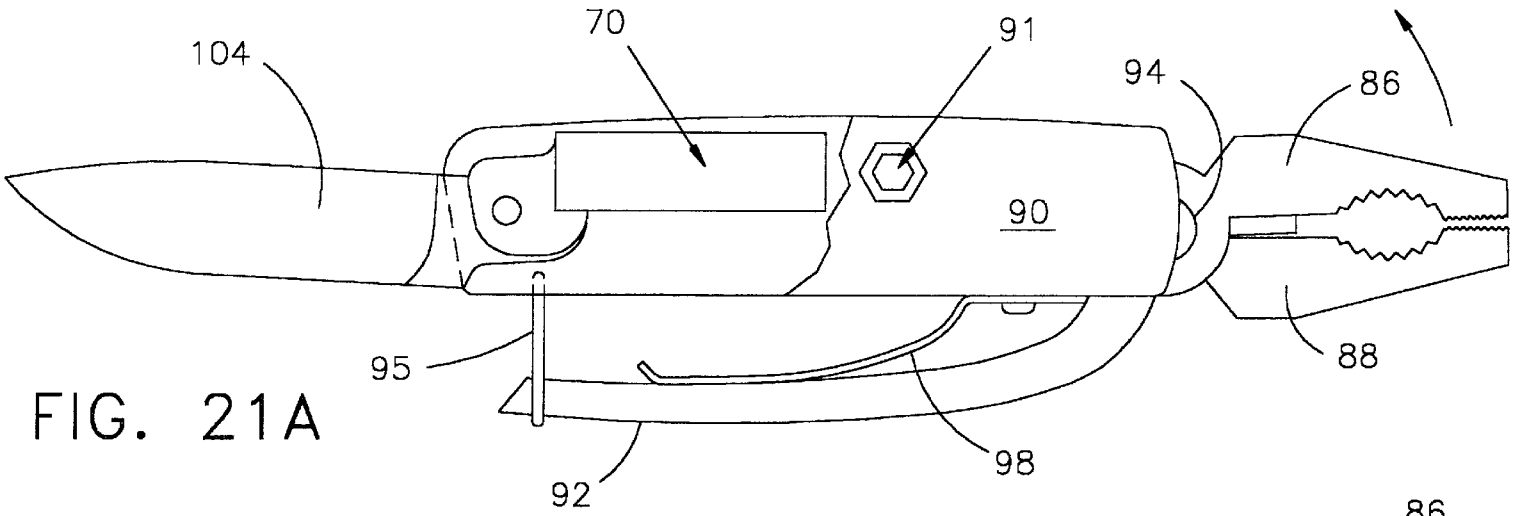
FIGS. 21A and 21B are views similar to that of FIG. 21 and 22, but with a centrally disposed crossbore on one handle for driving both the hexagonal driver sleeve and the hexagonal driver bit transversely to the axis of the tool handle.
Figure 21B:
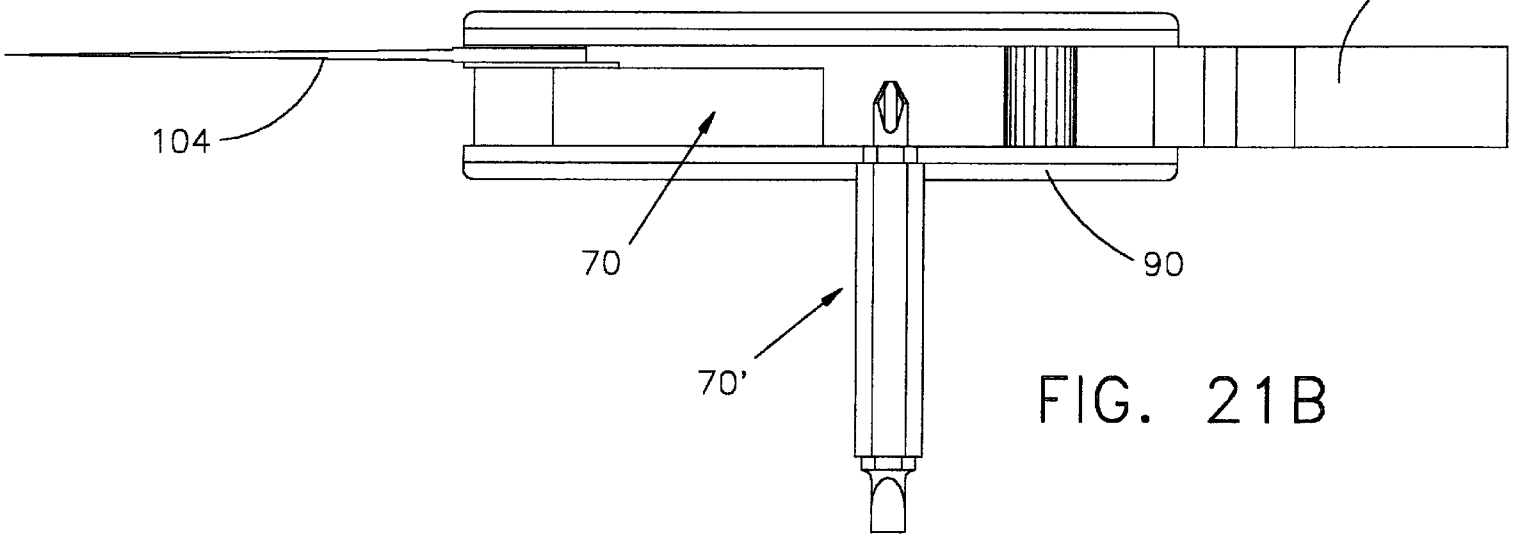

The fixed handle 90 is suitably equipped with a plurality of pivotable tool implements, such as a large knife 104 and a 4 in 1 or 8 in 1 driver tool, similar to that shown in FIGS. 6 and 15–19. The releasable locking mechanism (not shown) for holding such tool implements in the open position does not form part of the invention and is well known and conventional. In the embodiment of FIGS. 21A and 21B, the 4 in 1 driver sleeve 70' with dual bits at opposite ends thereof is shown removed from the pivotable sleeve 70 and positioned in the pair of hexagonal bores 91 provided in a side of the handle 90.

FIGS. 21A and 21B show the tool also, optionally, having at least one dual transverse hexagonal crossbore 91 in one or both handle sides (one shown). The crossbore 91 is of a desired, predetermined size for mating with either or both of an hexagonal driver bit or a hexagonal sleeve-hexagonal driver bit, thereby enabling the tool be gripped about the handle with the 4 in 1 screwdriver 70' midway between a user's four fingers. With such a tool arrangement, one has greater flexibility in employing such tool for various applications of driving or un-driving fasteners. Dual hexagonal crossbores 91 enable greater torque capability, and less "slippage" and/or wearing of the hexagonal bores provided in the laminated handle sides, which are conventionally made either entirely or laminated of metal, plastic, or the handle sides could even be a combination of both materials. In any event, one hexagonal connection is adequate for driving fasteners. Of course, suitable clearance must be provided between the side walls or side bolsters for a protruding drive bit, and there can be n( interference with any of the other pivotable elements or tools in the folding hand tool. Nevertheless, depending upon the size of the tools and the handle length, a tool can be pivoted into the open position, if necessary for clearance.

Figure 15:
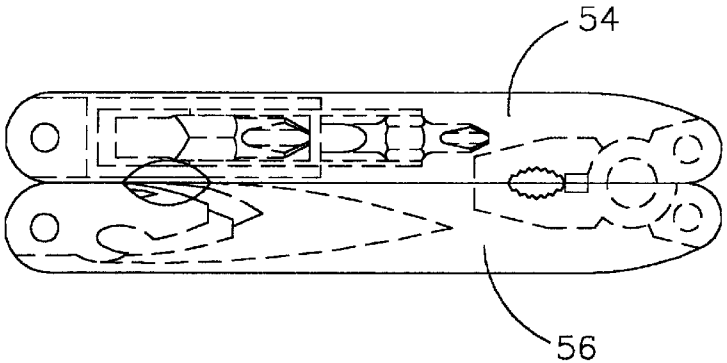
FIG. 15 is a side elevational view of the hand/survival tool shown in FIG. 14, but with all tool implements and/or blade-like devices folded into the pivoted and linked pair of handles (with all of the innards shown in phantom).
Figure 16:
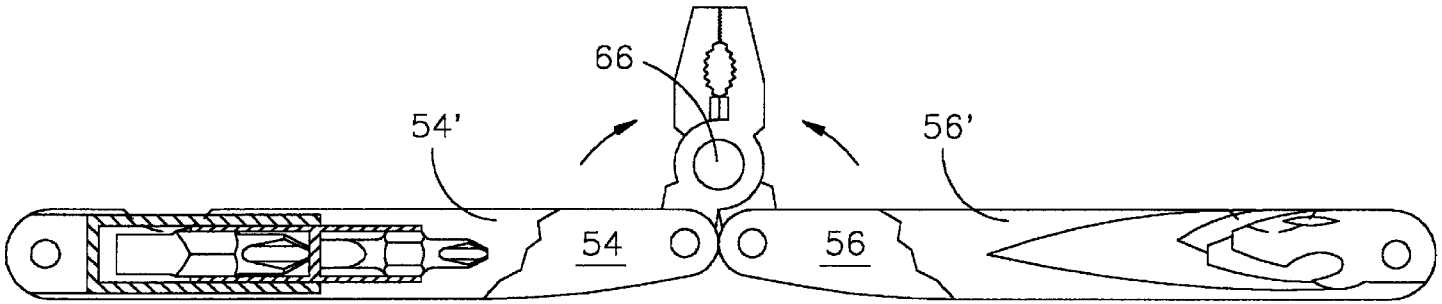
FIG. 16 is a side elevational view, similar to that of FIG. 15, but partially broken away, and showing both handles folded outwardly about 90 degrees.
Figure 17:
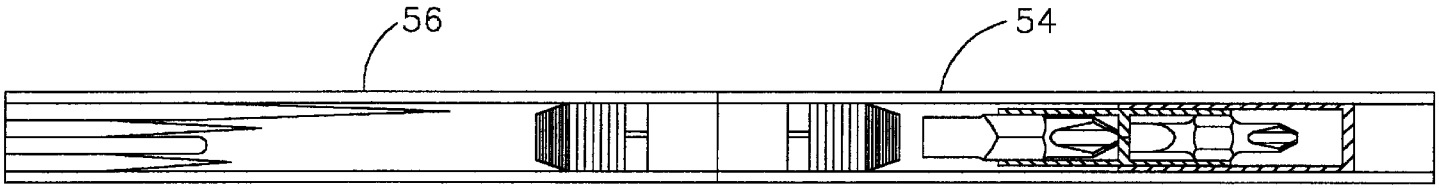
FIG. 17 is a bottom view or a view looking into the handle cavities or compartments and showing all of the tool implements and/or blade-like devices folded into their storage positions, and with the plier-like jaws shown also pivoted back into their respective portions of the handle cavities or compartments.
Figure 18:
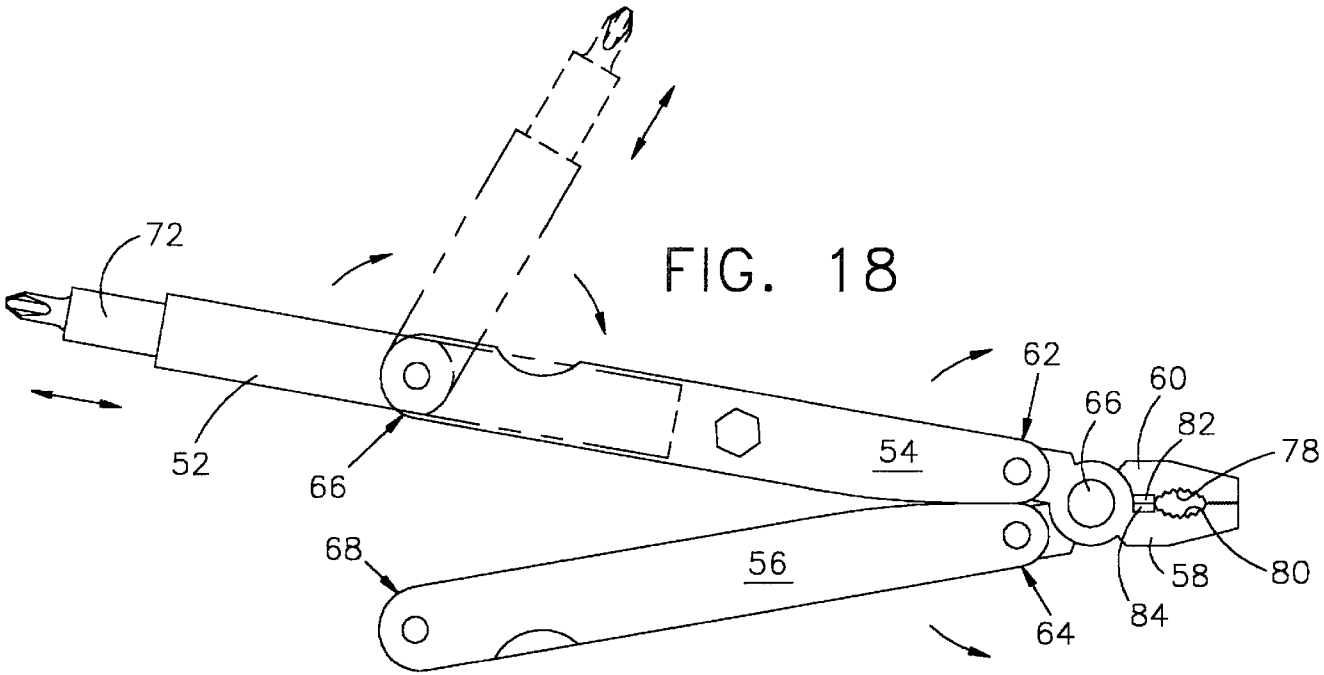
FIG. 18 is a side elevational view of the hand/survival tool shown in FIGS. 14–17, but with both handles folded about 180 degrees from their stored/folded abutting position, and with a 4 in 1 screwdriver tool shown both in its locked, fully extended operative use position, and in phantom at about 75 degrees, and in its stored position without the 4 in 1 screwdriver tool.
Figure 19:
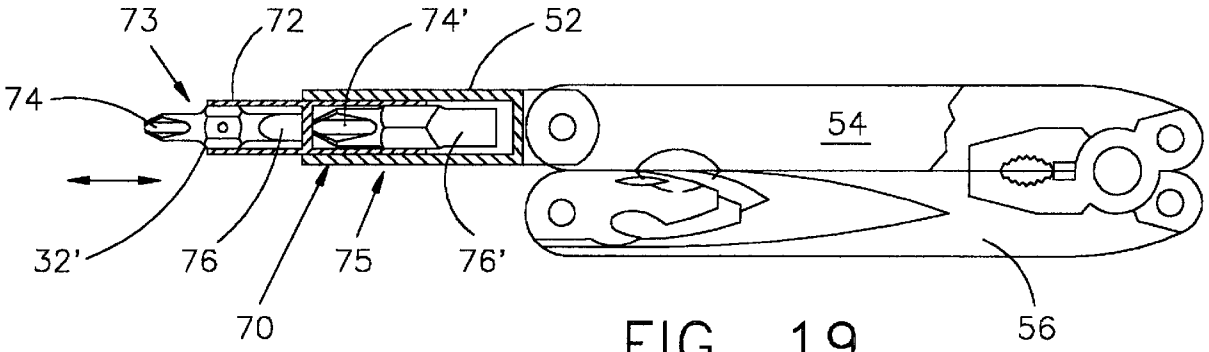
FIG. 19 is a side elevational view, similar to that of FIG. 15, but with the pair of handles, shown partly broken away, to illustrate the stored tool implements; and with the 4 in 1 screwdriver tool shown in section in its extended operative position for use by the user with one of the two sized Phillips head screwdriver bits.
Figure 24:
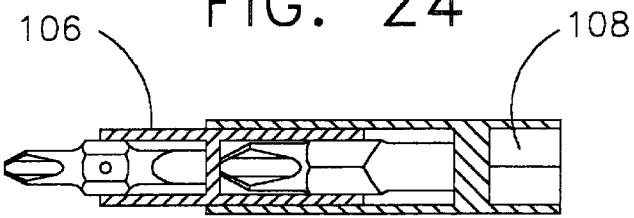
FIG. 24 is a sectional view of the driver/holder of FIG. 23, and showing therein a pair of hexagonal bits retained at opposite ends in their respective hexagonal compartments.
Figure 23:
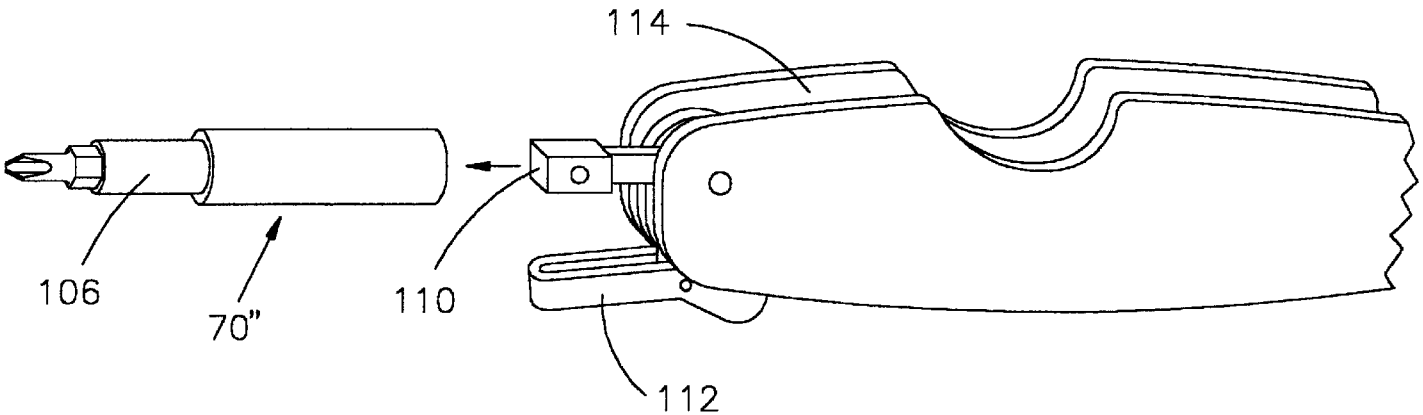
FIG. 23 is an exploded view of an alternate version of the invention where the cylindrical compartmented hexagonal sleeve member of the 4 in 1 bit driver/holder is independent of the knife handle, and is removably attached to a driver suitably pivotally mounted in the handle with conventional means for locking the driver in the in-line position with the handle.
Figure 25:
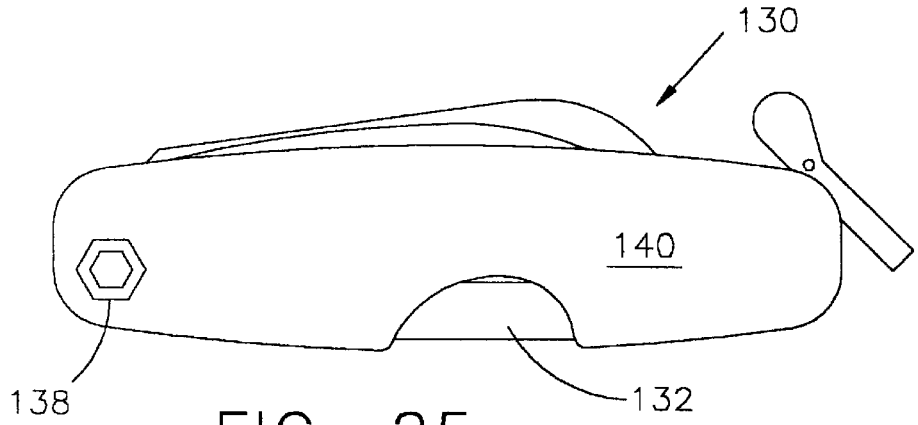
FIGS. 25–27 are other various view of the invention; and showing in such figures, particularly that of FIGS. 25 and 26 a dual crossbore at one end of the tool handle for mating with both the hexagonal driver sleeve and one of the hexagonal bits; and with this arrangement, greater torque than that of FIG. 21B would be available to the user due to the longer "lever arm" of the tool handle. Also, the hexagonal sleeve element provides a greater "extension" to the bit being driven.
Figure 26:
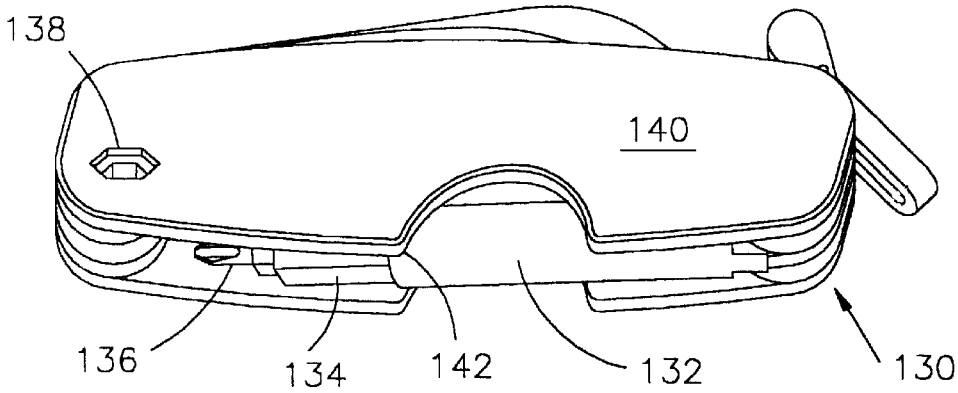
Figure 27:
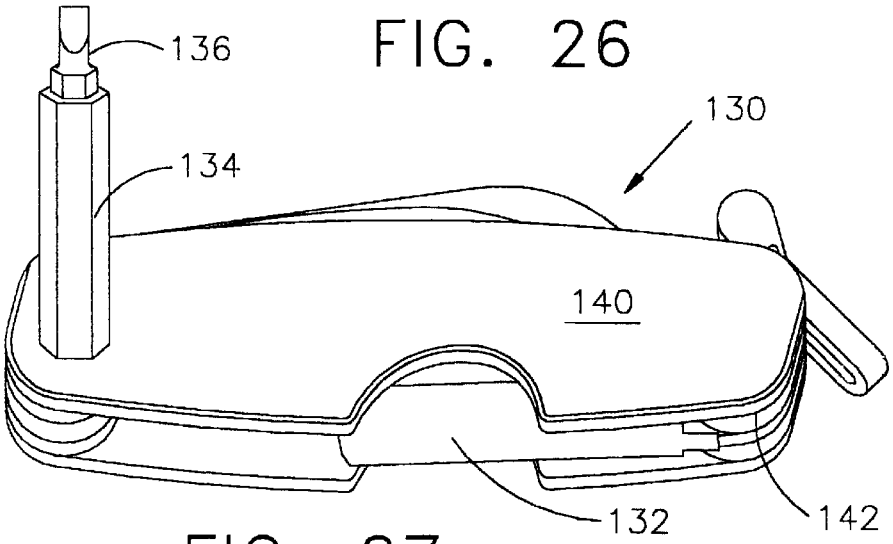

In FIG. 23, there is shown, partly broken away, an exploded view of a variation of the folding tool wherein just one of the tools provided, that is, the 4 in 1 driver tool 70" is only illustrated. Here such driver tool 70" is not fixedly pivoted to an end of the tool handle, but is removably connected by suitable ball detent means (or magnets or by retaining clips) to a polygonal socket connection-drive means 110 for the 4 in 1 driver tool 70", such as hexagon or square as shown. Of course, mating grooves and ears as shown in FIG. 15 could also be used. The inner sleeve 106 and its drive bits are the same as that of the 4 in 1 driver tool 70 of FIGS. 14–22, as shown, the inner sleeve 106 is also suitably secured by ball detent or other said means noted herein, for example, to the outer sleeve; and is suitably precluded from rotating with respect thereto so as to transmit torque therethrough by means of a pair of mating grooves 51 in the outer sleeve and a matching pair of protruding ears 53 on the inner sleeve (not shown), but same is well known in the art, and illustrated in FIG. 14 for convenience. FIG. 24 simply shows the female square 108 at one end of the driver tool 70". U-shape element 112 is conventional and is connectable to a conventional flat cam-like element (not shown) for facilitating the locking and pivotable movement of the square socket connection-drive means 110 from the closed stored condition to the open, longitudinally extending locked position. While such well known "linkage" can be used for other tools of the improved hand/survival tool of the invention, here in the present application, it is just employed for the square drive means 110 which is small and difficult to reach and pull out of the cavity/compartment 114 where one's fingers are large and/or to big for grasping the drive means 110 and pulling same out of its storage position in the cavity or compartment between the two flat handles or bolsters of the improved folding/survival tool of the invention.

Figure 28:
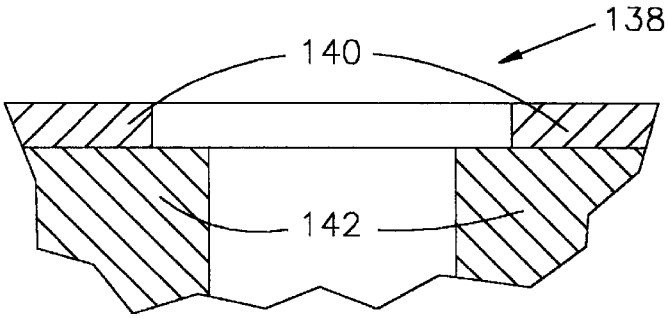
FIG. 28 is a partial sectional view showing a "laminated" tool handle with the crossbore driver aperture formed in a plurality of planes, such as those formed by two metal plates.
Figure 29:
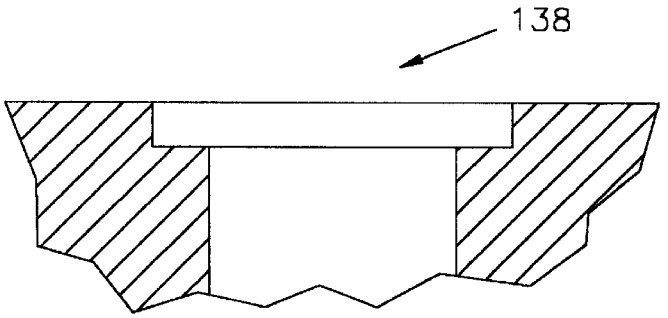
FIG. 29 is a view, similar to that of FIG. 28, but showing two hexagonal bores in the same or like material, such as plastic, although metal, steel or other material could be used.
Figure 30:
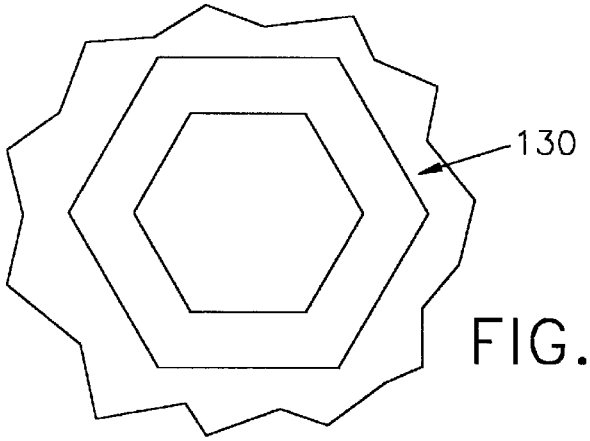
FIG. 30 is an enlarged plan view, broken away, of just the crossbores of FIGS. 28 and 29 showing their coaxial bores or hexagonal shapes which are in coincidence with respect to each other for mating with the hexagonal shapes of both a driver bit and a hexagonal driver element/sleeve where the tool desired requires a longer extension or reach (see FIG. 31).
Figure 31:
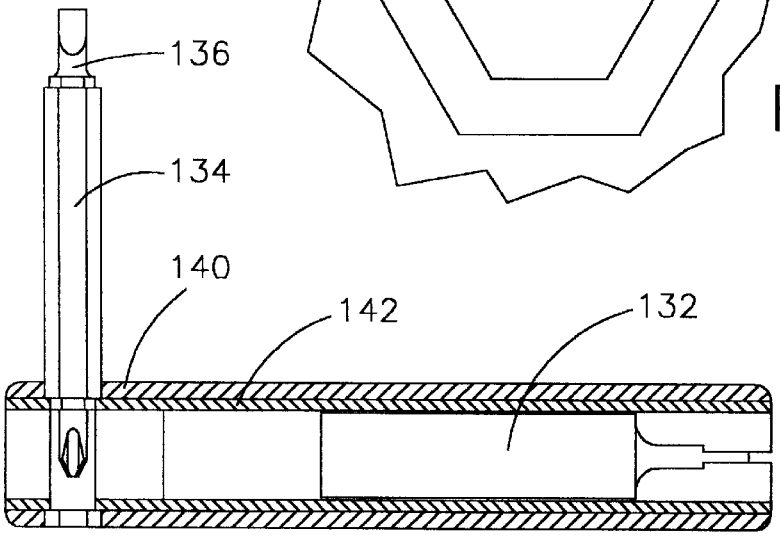
FIG. 31 shows in section the dual driving surfaces of the hexagonal crossbores in both sides of the laminated tool handles (similar to that shown in FIG. 21B).

In FIG. 25–31, one or more, differently sized, dual crossbore 138 (one shown) is suitably positioned at one end of a folding tool so as to provide maximum lever advantage to the user. In all other respects, the embodiment of such FIG. 25–28 is similar to that of FIG. 21B where both an inner hexagonal sleeve and the hexagonal bits are employed to transfer torque from one turning the tool handle to transmission through the bit and sleeve to a fastener being driven or undriven. FIGS. 28 and 29 show partial cross-sectional views of a laminated handle (FIG. 28) and a one-piece handle side (FIG. 29), with FIG. 30 showing in plan view the dual hexagonal crossbore which mate with a 4 in 1 driver sleeve and one of its hexagonal drive bits.

As shown in FIGS. 25–31, the folding knife/tool 130 of the invention is suitably provided with various knives, bottle and can openers, etc. as well as either a 4 in 1 or 8 in 1 driver tool which employs a pivotable outer sleeve 132 and inner hexagonal sleeve 134 with its oppositely disposed drive bits 136 (one shown). In this tool, suitable dual crossbores 138 may be positioned in the laminated sides 140, 142 of the handle, thereby enabling transmission of torque transverse to the handle axis when the inner hexagonal sleeve 134 and drive bit 136 are engaged with the crossbores 138. Considerable mechanical advantage is achieved when the improved tool of the invention is employed in this manner.

Note that FIG. 28 shows broken away a greatly enlarged cross-sectional view of the laminated metallic sides 140, 142 (see also FIGS. 25–27 and 31). FIG. 30 is simply an illustration of the hexagonal crossbores 130 in the laminated plates 140 and 142.

Figure 32:
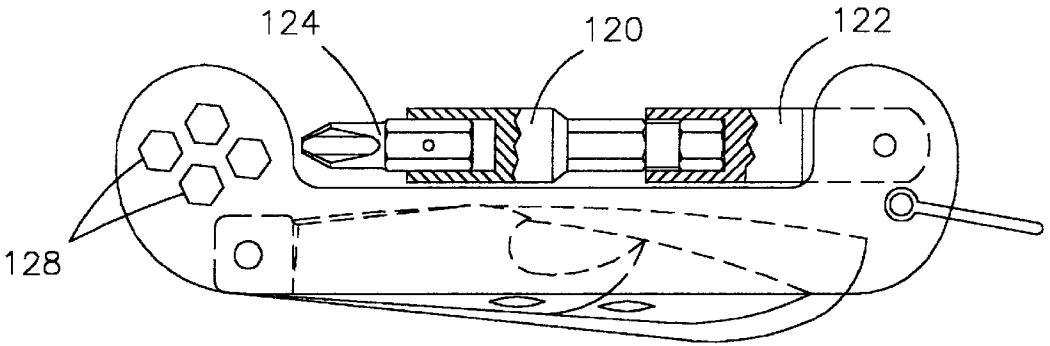
FIGS. 32–34 are views of a further folding knife tool having a "chuck" or bit holder which is removably connected to a pivotable element. The entire element and "chuck" can be stored within the cutout bay of the tool handle, and anyone of a plurality of drive bits (one shown) stored in the transverse crossbore can be substituted for the drive bit connect to the "chuck".
Figure 33:
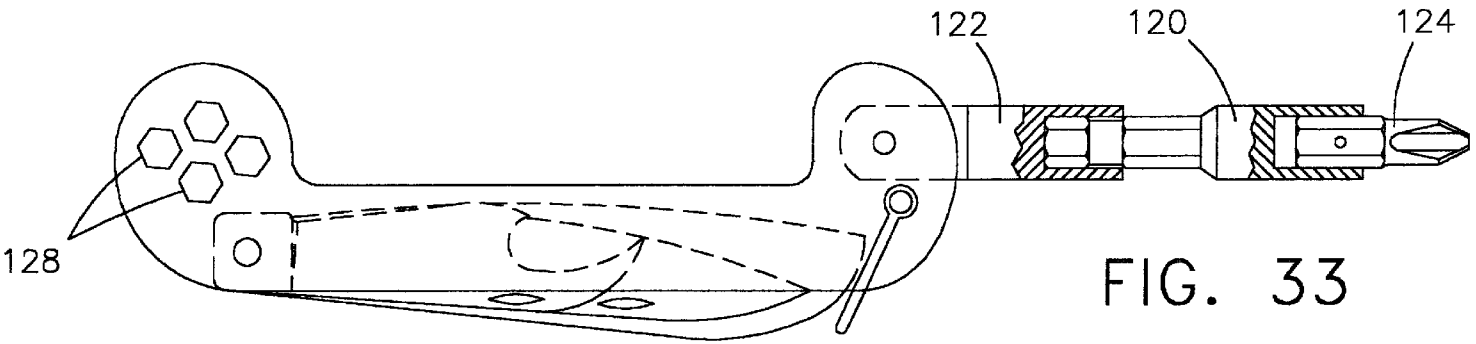
Figure 34:
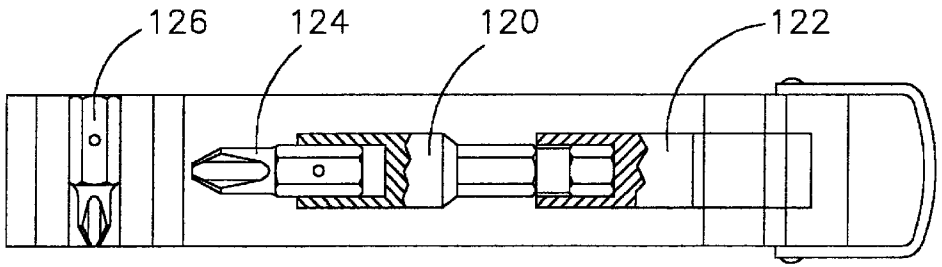
Figures 35, 36, 37, 38:
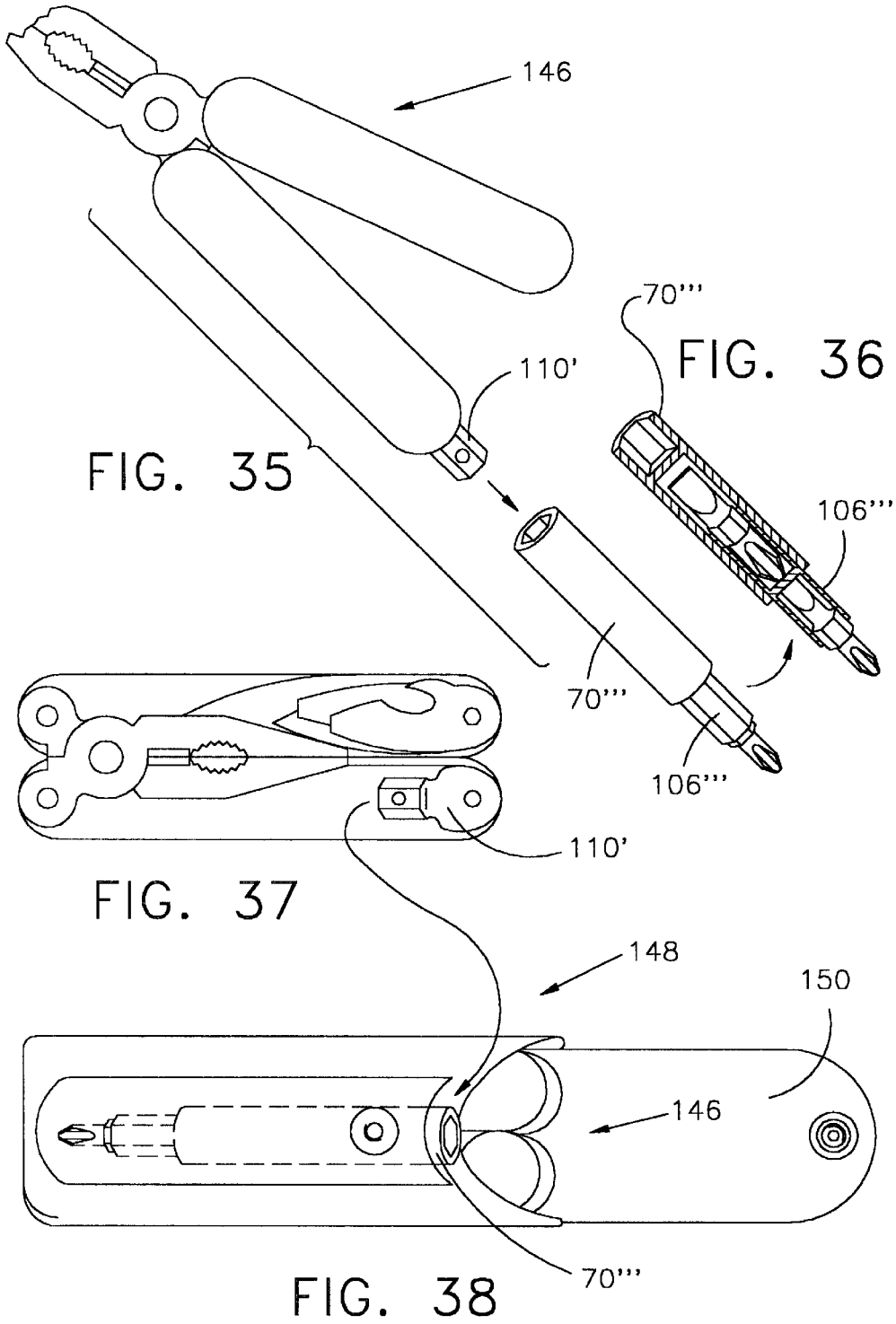
FIGS. 35–37 are views similar to that of FIGS. 15 and 19 but showing a long nose pliers both with a fixed end connection as well as with a pivotable end connection with a removably connected "chuck" or driver element (FIG. 37) for a hexagonal driver having dual hexagonal bits at opposite ends thereof; with FIG. 37 showing removal of the driver tool element when the tool is folded for storage due to the length of the jaws of the pliers.
FIG. 38 illustrates a storage case with a pair of pockets, one for storing the folded tool of FIG. 37, and the other smaller one for storing the removable "chuck" or driver element.

In FIGS. 32–34, a further improved folding tool has a large cutout bay for a conventional bit "chuck" 120 which is removably securable by well known means to a pivotable outer sleeve like element 122 which may be provided with a hex or square bore for torque transmission. The hexagonal driver bit 124 is seated in the hexagonal inner bore of the chuck 120 and held therein by a suitable ball detent, magnets, retaining clips or the like. A plurality of drive bits 126 (one shown) may be suitably stored and held by the aforesaid ball detent means in a plurality of hexagonal through bores 128 passing through the body of the tool from side to side. Thus, in the embodiment shown, five bits could be conveniently stored, one in the chuck and four in the tool itself. If desired, other additional bits can be placed in crossbores where space is available and does not interfere with action of any of the tools. However, if desired, one can separately carry with the tool itself extra bits in a pouch for holding the tool and the extra bits of various sizes and/or shapes or styles, such as those well known in the marketplace (star or Torx, pin-type, Phillips, flat, etc.).

In FIGS. 35–38, an improved shorter version plier-like tool 146, such as the Leatherman type of FIGS. 14–19, but with a suitable hexagonal drive means 110' (similar to the square drive means of FIG. 23). In a like manner, this embodiment may utilize in lieu of a square or hexagon drive means mating grooves and engaging protruding wings or ears for transmitting rotational motion therebetween. Such drive means 110' may be male or female, pivotable or not, protruding or recessed, polygonal or otherwise so shaped for transmitting torque (such as mating grooves and ears), and may also be suitably provided with a conventional flat cam-like element (not shown) for facilitating the pivotable movement of the square socket convention-drive means 110' from the closed stored condition to the open, longitudinal extending locked position. The removable driver tool 70" drives the mating hexagonal inner sleeve 106" which in turn drives either of the hexagonal bits from its inner hexagonal cavities. Case 148, suitably of leather, with a "snap-like" closure cover 150 has a pair of pockets as shown for holding the plier-like tool 146 and the removable driver tool 70". Of course, it will be appreciated that the distal end mating connection for the driver tool element may be male or female or vise-versa, such as similarly shown in FIG. 32.

Figure 39:
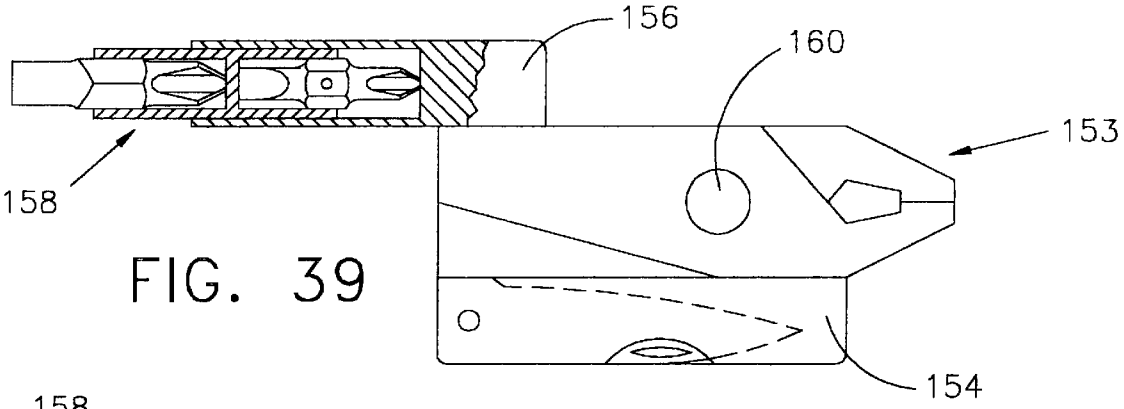
FIGS. 39 and 40 are side elevational views, partly in section, of an alternate more compact, plier hand tool, but with handles having storage cavities, and which pivot perpendicularly to that of the pivot axis of the plier jaws.
Figure 40:
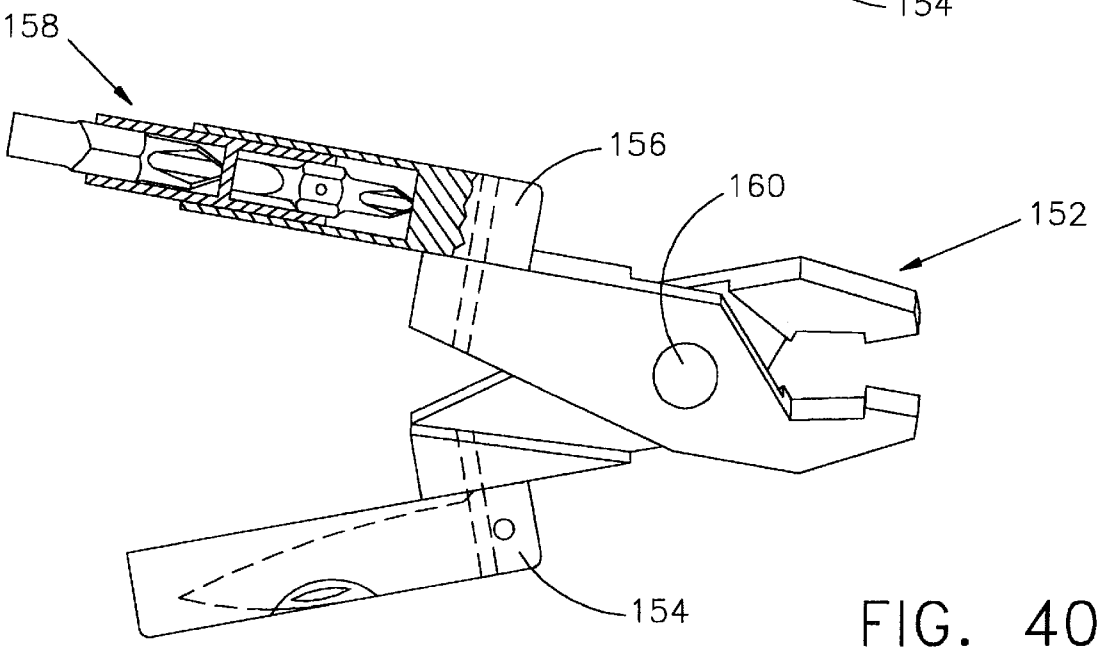

In FIGS. 39–40, other improved tools are illustrated and these are all equipped with at least one 4 in 1 or 8 in 1 type driver tool depending upon the size of the tool desired. For example, the collapsible/foldable clamp embodiment 152 of FIG. 40 as well as the plier embodiment 153 of FIG. 39 are each equipped with pivotable distal leg portions 154, 156 having hollow cavities for either a knife as shown therein or other tools, such as the 4 in 1 screwdriver tool 158, which is similar to that of the screwdriver tools shown in FIGS. 14–19, and 20–22. Here, however, the pivot axes of the legs 154, 156 are on axes transverse to that of the jaws pivot 160 which is in contrast to the print axes of the handles 54, 56 of FIGS. 14–19 which are parallel to that of the jaws 58, 60 of such other Leatherman type tool embodiment.

Figure 41:
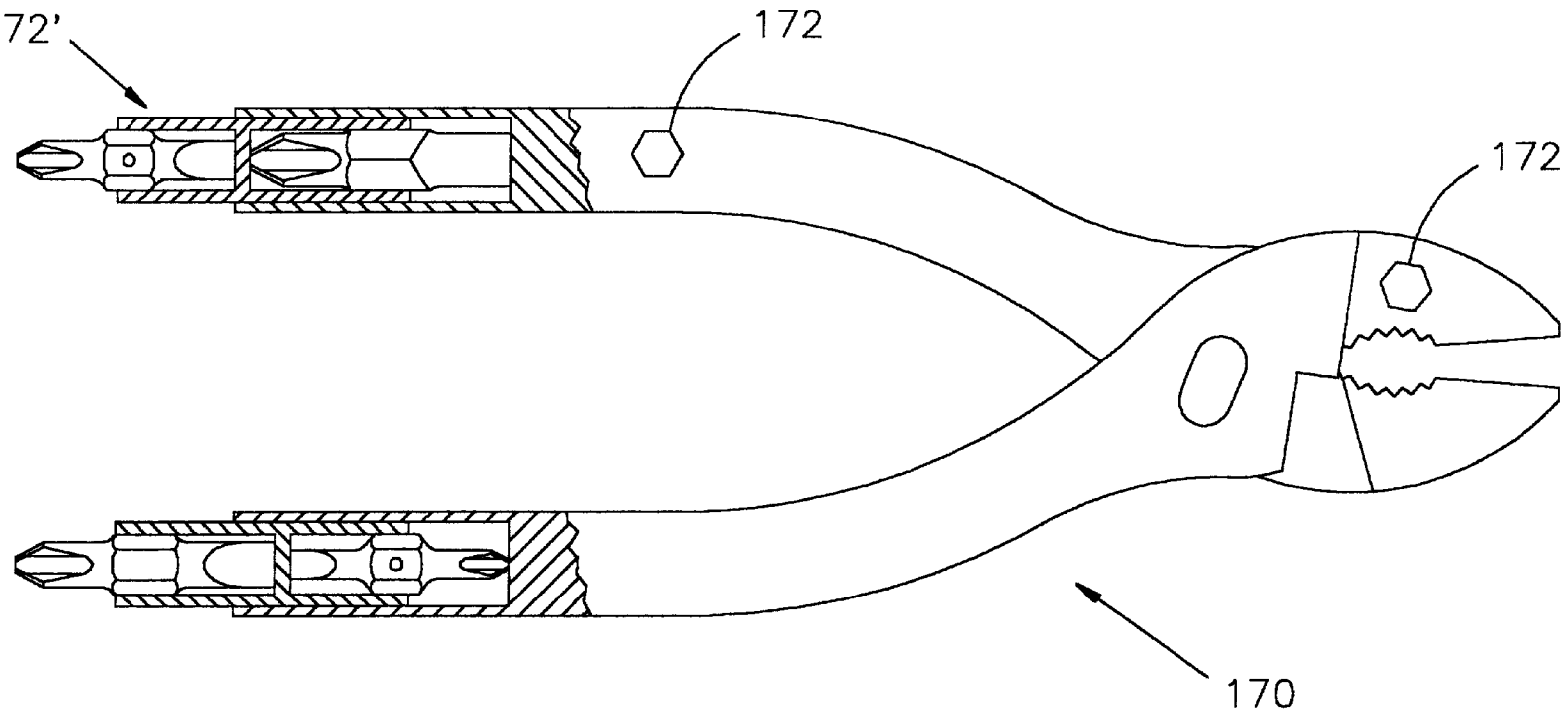
FIG. 41 is a side elevational view of a more conventional type pliers, but with handles having hollowed distal end portions for containing either 4 in 1 or 8 in 1 bit drivers of either the blade type or the nut types.

In the plier tool 170 embodiment of FIG. 41, each leg thereof is hollow at its distal end for supporting therein a 4 in 1 screwdriver tool or other type of driver tool such as a nut driver or any combination thereof, such as those disclosed in our aforesaid copending U.S. patent application. Such plier tool 170 may also be equipped with one or more hexagon cross-bore holes 172 for enabling the hexagonal central portion of a tool bit to be suitably held therein, and using the handles of the plier tool as a fulcrum-lever aid for torquing a bit as required in driving/undriving a fastener or nut. The inner sleeve 72' with it dual bits is similar to that shown with respect to FIGS. 14–22

Figure 42:
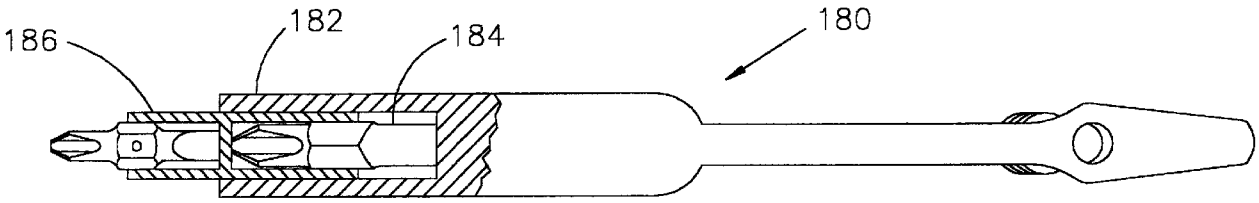
FIGS. 42–44 are various views of an adjustable type monkey wrench embodiment, partly in section so as to more particularly illustrate the 4 in 1 screwdriver tool shown at the distal end of the wrench handle.
Figure 43:
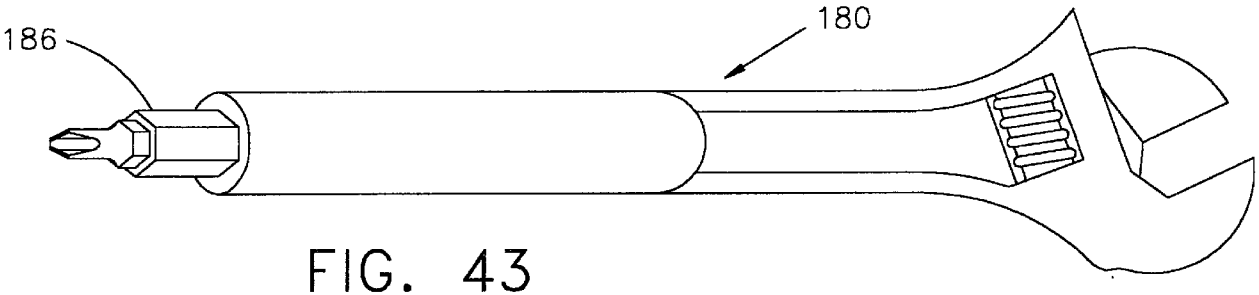
Figure 44:
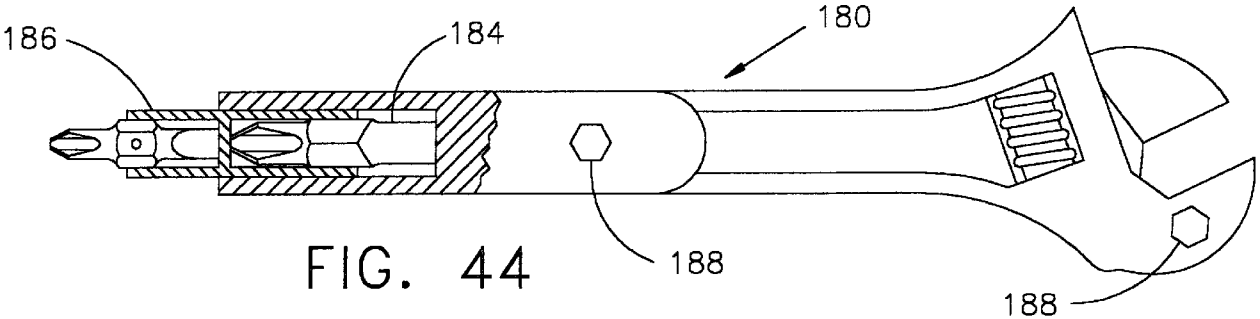

In the embodiment of FIGS. 42–44, there is shown a adjustable wrench 180 with its distal end handle 182 having hollow cavity 184 for mating with the reversible hexagonal 186 holding at opposite ends thereof a pair of reversible bits. This tool is also suitably provided with one or more hexagon cross-bore holes 188 similar to that of the tool of FIG. 41 except with one hole in the fixed jaw and the other hexagonal hole in the handle.

Referring, for example, to FIGS. 39 and 40, a multifunctional hand tool is illustrated that generally defines a longitudinal axis A and first and second longitudinal ends E1 and E2. The pliers embodiment 153 forms adjustable gripping means provided at the first longitudinal end E1 for selectively gripping a work. The screwdriver tool 158 forms a multiple driver bit attachment at the second longitudinal end E2 for selective movements between a retracted storage position when the driver bit attachment is not used and an extended position, as shown in FIGS. 39 and 40, for using one of the driver bits. The driver bit attachment comprises at least one inner sleeve 158, mounted on the tool 153 for removably securing a reversible hexagon drive bit, as shown, in a manner enabling torque to be transmitted between the inner sleeve 158' and the drive bit 158".

Figure 45:
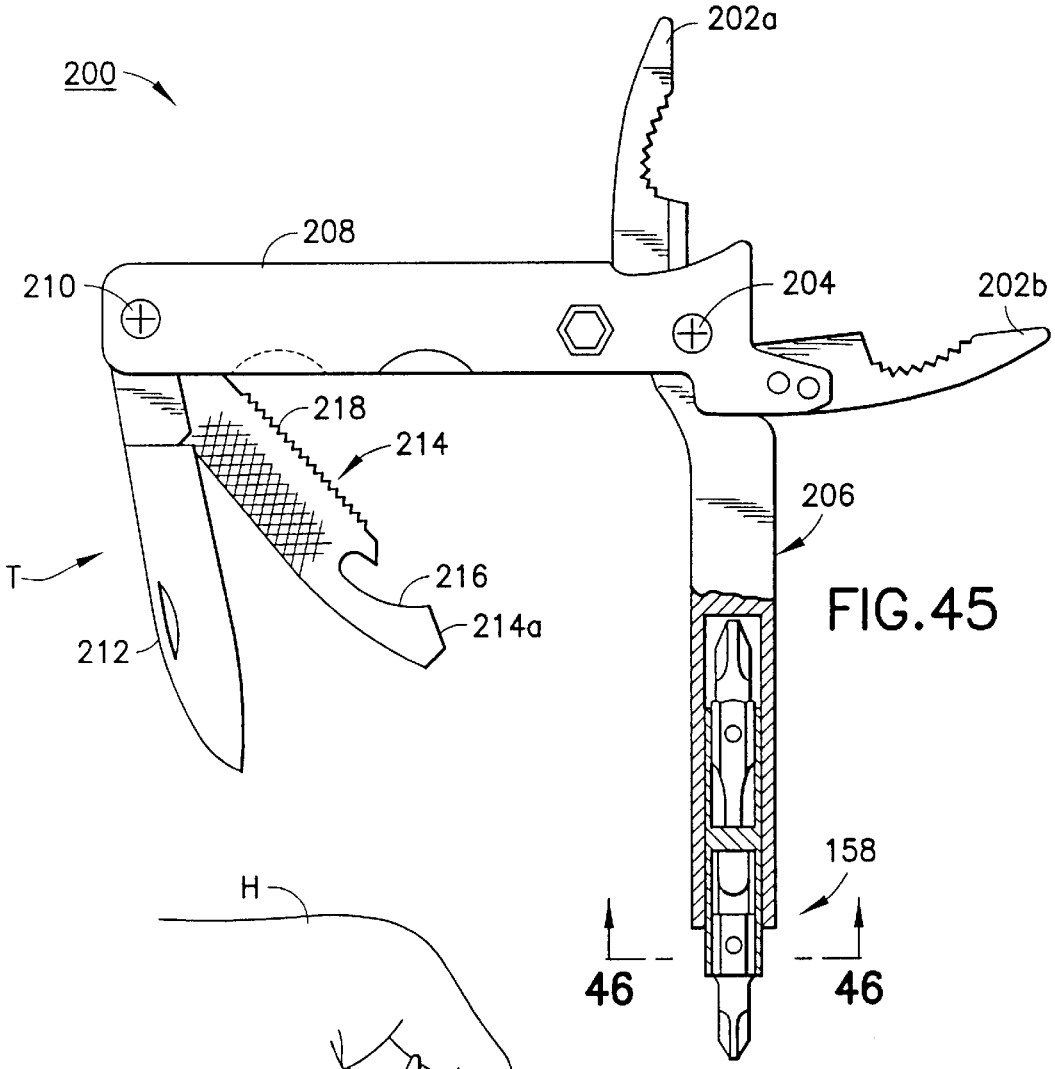
FIG. 45 is a plan view of a pliers and interchangeable bit screwdriver in accordance with the invention mounted on one handle of a pliers and provided with additional tools that are pivotally mounted at the end of the other handle of the pliers.

Referring to FIG. 45, an additional embodiment 200 is illustrated in accordance with the invention which also incorporates a pliers attachment. Here, therefore, a gripping attachment is provided which is in the form of jaws 202*a*, 202*b* that are pivotally mounted relative to each other about a pivot pin 204. The jaw 202*a* is attached to a handle 206 and the other jaw 202*b* is attached to a handle 208. The handles 206, 208 are pivotally movable relative to each other about the pivot pin 204 to provide relative movements of the jaws 202*a*, 202*b*, as shown. As in the embodiment illustrated in FIGS. 39, 40, the multiple drive bit attachment is mounted at the free end of one of the handles 206. The multiple driver bit attachment or screwdriver tool 158 is otherwise constructed and operates the same as the ones previously described. The tool 200 comprises at least one additional tool T pivotally mounted at the free end of the handle 208 about the pivot pin 210. In the embodiment illustrated, such additional tool can comprise a knife blade 212 and/or a flat file 214 having a free end 214*a* and a pivoted end mounted within the handle 208. The free end 214*a* of the flat file 214 may be provided with a bottle cap remover 216, as shown. Additionally, the flat file may be provided with at least one serrated edge extending at least along a partial length of the file 214 between the free and pivoted ends.

Figure 47:
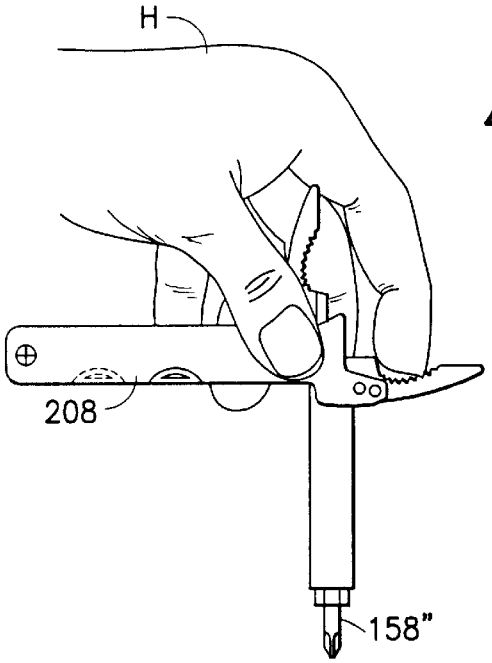
FIG. 47 illustrates the embodiment shown in FIG. 45 as it would be normally used for driving a fastener with a bit driver.
Figure 46:
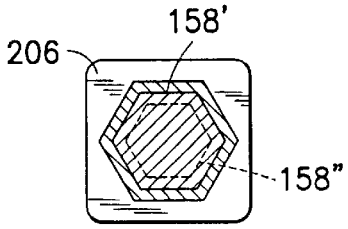
FIG. 46 is a cross sectional view of the sleeve and bit mounted therein, taken along line 46—46 in FIG. 45.

In the embodiment 200, the additional tools T are mounted for movement about a pivot axis of the pivot pin 210 which is substantially parallel to the pivot axis of the pivot pin 204 about which the jaws 202*a*, 202*b* are mounted for movement. Preferably, the handles 206, 208 are pivotally movable to relative positions shown in FIG. 45 to substantially an angle of approximately 90° for positioning the multiple driver bit attachment 158 in the extended or operative position. This can best be appreciated from FIG. 47, in which the handle 208 can be gripped by the hand H of the user to facilitate the transmission of maximum torque to the driver bit 158". FIG. 46 illustrates a cross section of the screwdriver tool or multiple driver bit attachment 158 to show the details thereof.

Referring again to FIGS. 39 and 40, the jaws of the pliers embodiment 153 are pivoted for movement about a first axis of the jaws pivot 160, the multiple driver bit attachment or screwdriver tool 158 being pivotably mounted on the handle or leg 156 for movements about a second axis $A_2$ substantially transverse to the first axis of the pivot pin 160 to be movable between a retracted position (not shown) proximate to the jaws of the pliers embodiment 153 and an extended position remote from the jaws as shown. The other leg or handle 154 is provided with at least one additional tool pivotally mounted about a pivot pin 154'. Such tool can comprise, for example, a knife blade 154". The knife blade is preferably mounted in a generally elongate tool Q that is pivotally mounted on the leg or handle 154 for movements about a second axis $A_2$ substantially transverse to the first axis of the pivot pin 160 to be movable between the position proximate to the jaws of the pliers embodiment 153 (as shown in FIG. 39) in a position remote from the jaws (as shown in FIG. 40). In the embodiment of FIGS. 39, 40 the tool holder H effectively serves as a portion of one of the handles when moved to the extended position shown in FIG. 40. The tool holder H may either be pivoted about a generally transverse axis $A_2$ or may be slidably mounted, such as by a tongue in groove (not shown) to allow the tool holder H to slidably move between the retracted position shown in FIG. 39 and an extended position shown in FIG. 40. In both instances, the pivot pin 154' moves in a direction away from the jaws when the tool holder is moved to its operate, extended position.

Referring to FIGS. 48–51, a further embodiment 220 in accordance with the invention is shown which is more in the form of a Leatherman-type tool. The handle 206 is provided with a longitudinal cavity 222 extending to a free end as shown remote from the jaws 202*a,* 202*b*. The multiple driver bit attachment or screwdriver tool 158 is pivotally mounted about an axis of a pivot pin 224 to be movable between a retracted position (not shown) and an extended position, shown in FIG. 48, outside and substantially in line with the cavity 222.

Figure 48:
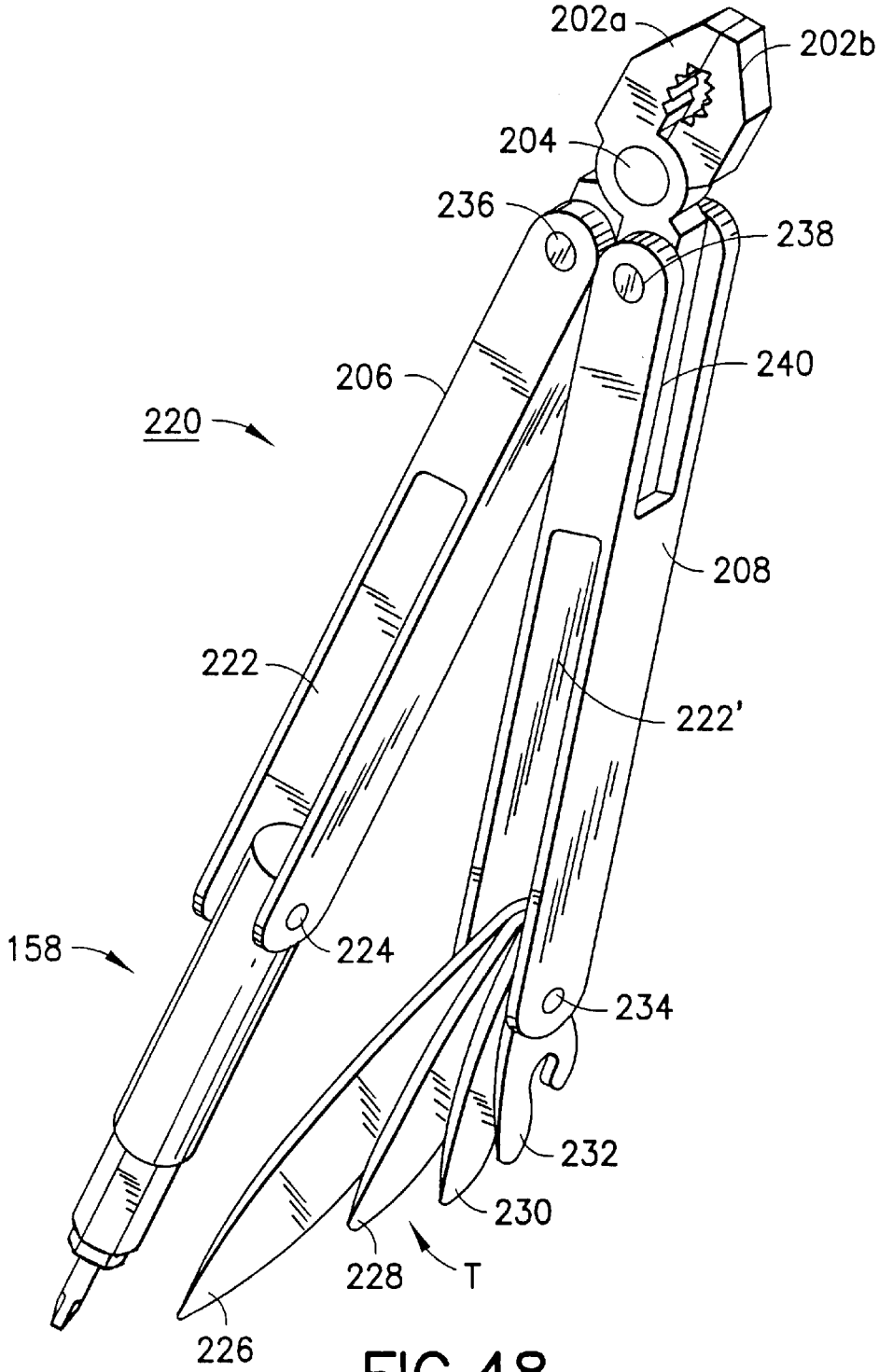
FIG. 48 is a perspective view of a Leatherman-type tool in accordance with the invention in which the multiple bit driver element is pivotally mounted at one free end of one of the handles and multiple additional tools are pivotally mounted at the free end of the other handle.
Figure 49:
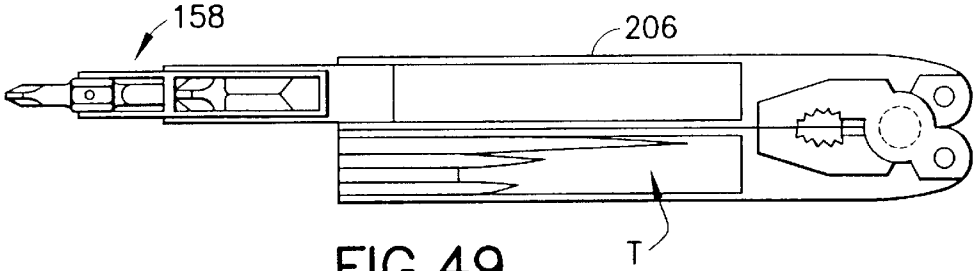
FIG. 49 is a plan view of the Leatherman-type tool shown in FIG. 48, with the handles folded to conceal the jaws of the pliers and with the knives retracted into the handle.
Figure 50:
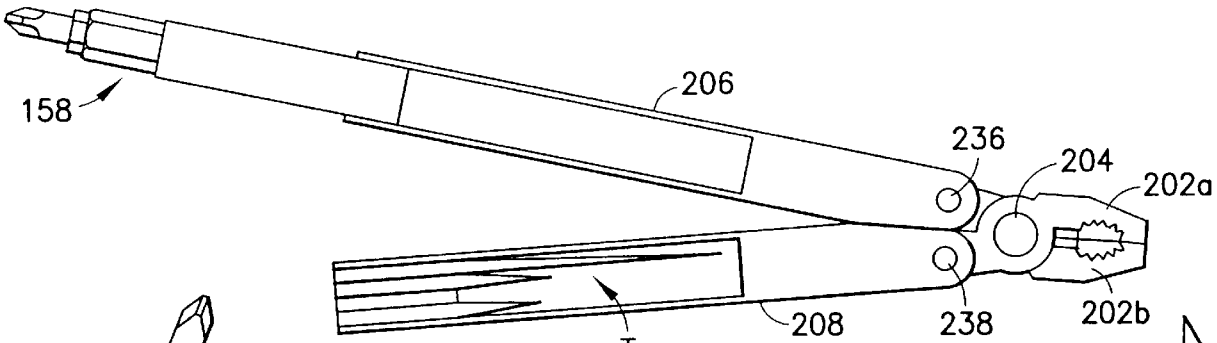
FIG. 50 is similar to FIG. 49, but with the handles folded to expose the jaws of the pliers.
Figure 51:
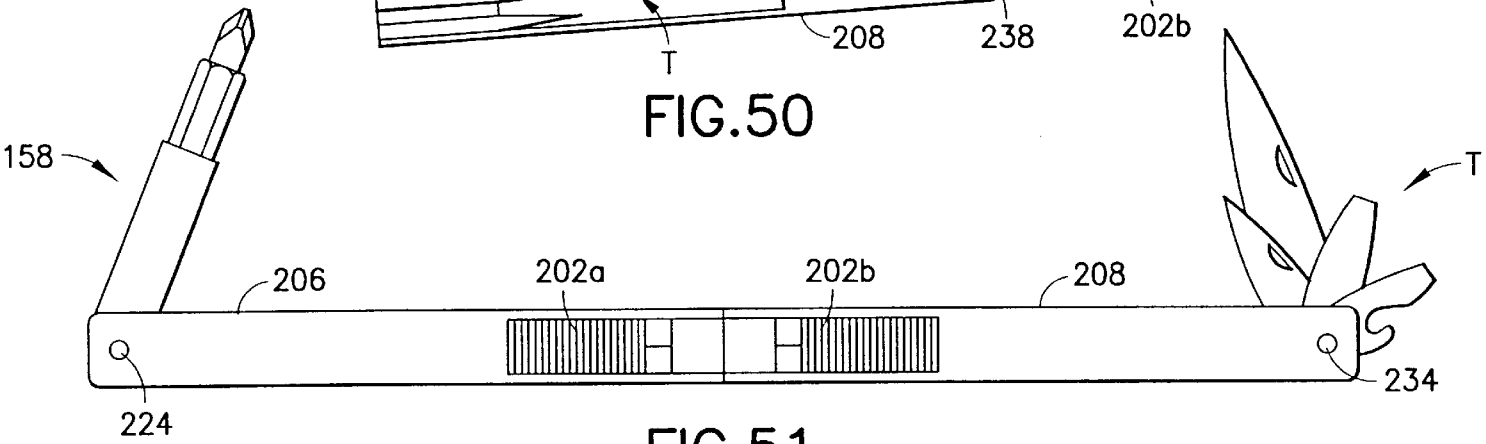
FIG. 51 is a side elevational view of the tool shown in the Figures shown in 48–50, in which the handles are pivoted 180° from each other, and further showing the blades pivotally mounted on one of the handles partially extended and the multiple bit driver attachment pivoted at an arbitrary angle relative to the handle on which it is mounted.

At least one additional tool T is provided in the embodiment 220 which is pivotally mounted at a free end of the other handle 208. As suggested, such additional tool T can comprise differently sized knife blades 226, 228, a screwdriver or prying attachment 230 and bottle cap opener 232. The tools 226, 228, 230, 232 are all pivotally mounted on a pivot pin 234 which has an access substantially normal to the axis of the pivot pin 204 about which the jaws are pivotally movable. The tool illustrate in FIGS. 48–51, a Leatherman-type tool, has the handles 206, 208 pivotally connected to the jaws about pivot pins 236, 238 an are provided with recesses 240 for receiving the jaws 202*a,* 202*b* when the pliers is not used and the handles can be pivoted about the jaws up to 180° to conceal the jaws while still enabling use of the other tools mounted on the handles, as shown in FIG. 49. FIG. 50 is similar to FIG. 48, showing the additional tools T in retracted positions within the longitudinal cavity 222'. It may be pointed out, in this connection, that the cavities 222, 222', while shown open in a direction substantially normal to the plane of the tool itself, the cavities can be opened in directions facing away from the other handle in which the cavity is formed, in which cases the pivot pins 224, 234 also need to be rotated 90°. In FIG. 51 the tool 220 is shown in a fully open position in which the handles have been pivoted about the pivot pins 236, 238 so that the handles are in line with each other, being displaced by 180°.

Figure 52:
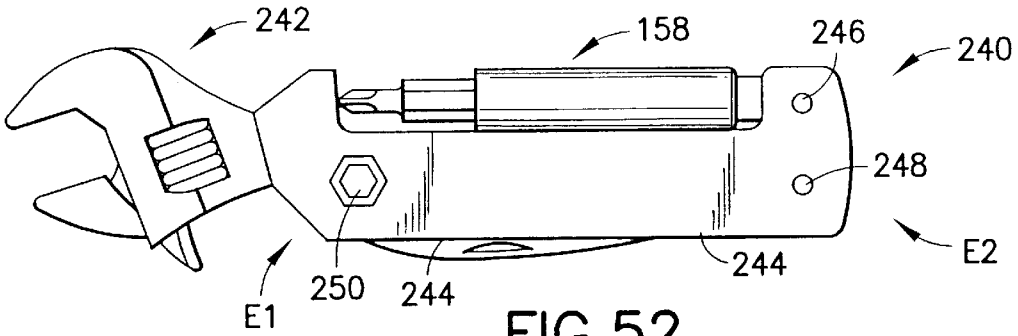
FIG. 52 is a plan view of another embodiment in accordance with the present invention, in which an adjustable wrench is mounted at one end of an elongate body and a multiple bit driver attachment is pivotally mounted at the other free end of the body, additional tools also being mounted at the other or second free end of the body and are in the nature of various flat blades such as a knife blade, a flat file blade, etc.
Figure 53:
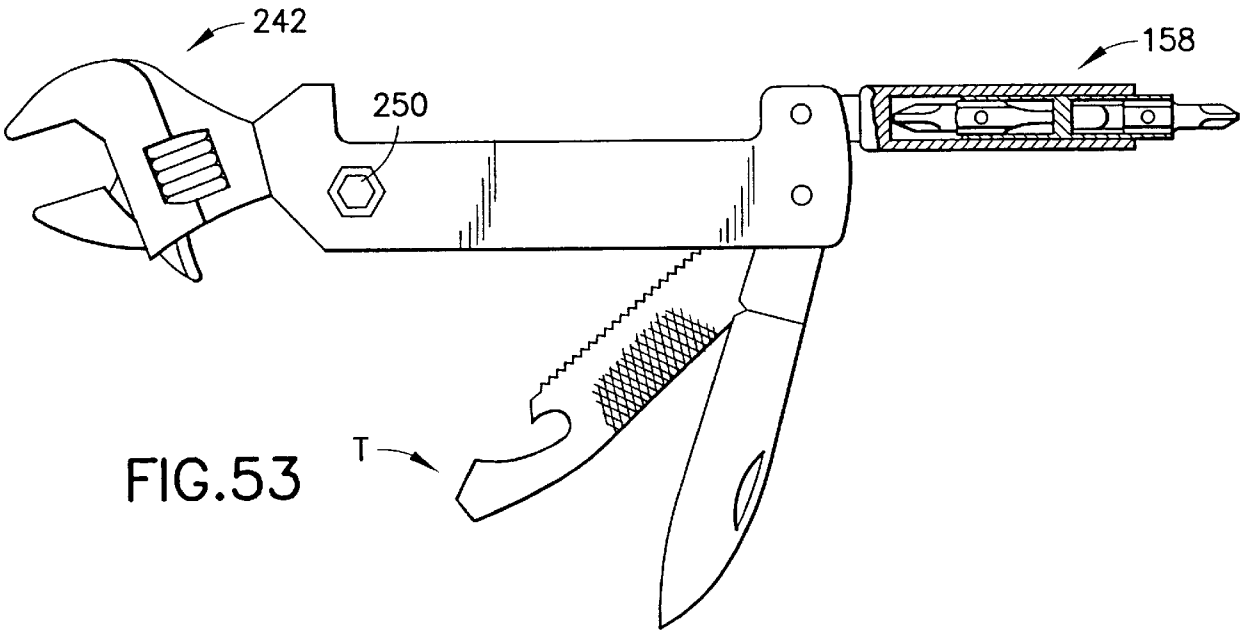
FIG. 53 illustrates a tool of FIG. 52, in which the multiple bit driver attachment has been pivoted 180° to an extended or operative position and the blades have been partially removed from the body.

Referring to FIGS. 52 and 53, a further embodiment 240 in accordance with the invention is illustrated, in which the adjustable gripping attachment is in the form of a wrench—more specifically a monkey wrench. The tool 240 includes a central body 244 to which the head of the wrench 242 is fixedly attached. The multiple driver bit attachment or screwdriver tool 158 is pivotally mounted on the body 244. While the adjustable wrench attachment is secured to one longitudinal end El of the tool 240 the screwdriver tool or multiple driver bit attachment 158 is pivotally mounted at the other or opposing end E2.

At least one additional tool T is provided and also pivotally mounted at the second end E2. The additional tool 244 in the nature of a knife blade, and the multiple driver bit attachment, are mounted about substantially parallel axes, as shown, represented by the pivot pins 246, 248. The specific additional tools used is not critical for purposes of the invention, and the same or similar tools may be used as indicated, for example, in FIG. 45.

Preferably, the body 244 includes receiving cavities for receiving the screwdriver tool or multiple driver bit attachment 158 within the body when in a retracted position, as shown in FIG. 52. The same is true for the additional tools. The body 244 may be provided with one or more hexagon cross-bores 250, to be used as previously described.

Although the present invention has been described in some detail by way of illustration and example for purposes of clarity and understanding, it will of course be understood that various changes and modifications may be made in the form, details and arrangements of the parts without departing from the scope of the invention as set forth in the following claims.

What is claimed is:

1. A multi-functional hand tool comprising, pliers jaws elongated handles having oppositely disposed first and second ends and each handle having opposed sides, and means for pivotally connecting the pliers jaws to the handles adjacent the first ends so that the handles open and close the pliers in a pliers operable position and hold the pliers closed in a pliers inoperable position, said means for pivotally connecting said pliers jaws comprising spacedly disposed pivot axes, said handles being in parallel disposition in said pliers inoperable position, interchangeable tool bit members, each tool bit member having a body member and oppositely disposed tool bits, sleeve means for removably holding said tool bit members, and means for pivotally connecting said sleeve means to one handle adjacent the one said handle second end said sleeve means being non-removably connected to said means for pivtally connecting said sleeve means, said sleeve means being pivotable about 180° from an inoperable position disposed between the one handle sides to an operable position disposed away from the one handle second end, said sleeve means comprising a sleeve having an open end formed to slidably non-rotatably receive at least one tool bit member, said sleeve being formed with an oppositely disposed closed end, said means for pivotally fixedly connecting the sleeve means being operably disposed in the sleeve closed end, said means for pivotally connecting said sleeve means being in transverse disposition with said spacedly disposed pivot axes, said other handle comprising a plurality of bladed tools, and means for pivotally connecting said bladed tools to said other handle, whereby the sleeve means with said tool bit members are pivotable from the inoperable position to the operable position.

2. The hand tool of claim 1, said pliers being disposed between the handles in the pliers inoperable position.

3. The hand tool of claim 2, said sleeve being disposed in the operable position with the pliers in pliers inoperable position, so that the user grips the parallel handle tool bit use without pliers interference.

4. The hand tool of claim 1, each said bladed tool and said sleeve being pivotable in the same direction with the handles in parallel disposition in the pliers inoperable position.

5. The hand tool of claim 1, each said handle comprising opposed parallel sides and having respective about equally sized compartments for respectively receiving the sleeve means and the bladed tools.

6. The hand tool of claim 1, further comprising a second sleeve, said second sleeve being formed of one-piece unitary construction and said second sleeve being formed with openings at opposite ends to slidable non-rotatably receive respective tool bit members, and wherein both said sleeves are pivotable about 180° from the inoperable position between the one said handle sides to the operable position where at one tool bit is operably disposed.

7. The hand tool of claim 6, wherein one tool bit is facedly disposed to the sleeve means closed end.

8. The hand tool of claim 1, wherein one tool bit is facedly disposed to the sleeve means closed end.

9. The hand tool of claim 1, wherein the sleeve means is cylindrical having a generally circular outer surface and a polygonal inner surface.

10. The hand tool of claim 9, wherein the sleeve means is a one-piece unitary construction.

11. A multi-functional hand tool comprising, pliers jaws, elongated handle having oppositely disposed first and second ends, and each handle having opposed sides, and means for pivotally connecting the pliers jaws to the handles adjacent the first ends so that the handles open and close the pliers in a pliers operable position and hold the pliers closed in a pliers inoperable position, said means for pivotally connecting said pliers jaws comprising spacedly disposed pivot axes said handles being in about parallel disposition in said pliers inoperable position, interchangeable tool bits, sleeve means for removably holding said tool bits, said sleeve means being formed with a closed end and an open end, said open end being formed to slide receive said tool bits, and means for pivotably connecting the sleeve means closed end to one handle second end so that the sleeve means is pivotable from an inoperable position between the one handle sides, said sleeve means being non-removably connected to said means for pivotally connecting the closed end, said other handle comprising a plurality of bladed tools, and means for pivotally connecting said bladed tools to said other handle second end.

12. The hand tool of claim 11, said sleeve means comprising an outer sleeve and a inner sleeve slidably non-rotatably secured in the outer sleeve, said inner sleeve comprising means for removably holding said tool bits.

13. The hand tool of claim 12, said inner sleeve comprising a one piece unitary construction formed with oppositely disposed recesses, each recess being formed for slidably non-rotatably holding one tool bit.

14. The hand tool of claim 11, said other handle second end comprising said means for pivotally connecting said bladed tools to said other handle.

15. The hand tool of claim 11, said handles being opened so as to be collinearly disposed, and said sleeve means is pivotable about 180° with the handles collinearly disposed.

16. The hand tool of claim 1, wherein the sleeve means is formed to stop four tool bits in the inoperable position.

* * * * *